US008686978B2

(12) United States Patent
Iisaka et al.

(10) Patent No.: US 8,686,978 B2
(45) Date of Patent: Apr. 1, 2014

(54) VIDEO PROCESSING CIRCUIT, VIDEO PROCESSING METHOD, LIQUID CRYSTAL DISPLAY APPARATUS AND ELECTRONIC DEVICE

(75) Inventors: Hidehito Iisaka, Shiojiri (JP); Hiroyuki Hosaka, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 628 days.

(21) Appl. No.: 13/005,139

(22) Filed: Jan. 12, 2011

(65) Prior Publication Data

US 2011/0176071 A1 Jul. 21, 2011

(30) Foreign Application Priority Data

Jan. 15, 2010 (JP) ..... 2010-006567

(51) Int. Cl.
*G09G 5/00* (2006.01)

(52) U.S. Cl.
USPC ..... 345/204; 345/87; 345/89; 345/690; 349/149

(58) Field of Classification Search
USPC ..... 345/87–100, 204, 211–215, 690–693; 349/56, 84, 123, 125, 130–151
See application file for complete search history.

(56) References Cited

U.S. PATENT DOCUMENTS

| | | | | |
|---|---|---|---|---|
| 8,411,104 | B2 | 4/2013 | Arashima et al. | |
| 8,452,119 | B2 | 5/2013 | Arashima et al. | |
| 2007/0063947 | A1* | 3/2007 | Kang | 345/89 |
| 2008/0018630 | A1* | 1/2008 | Fujino | 345/205 |
| 2009/0153743 | A1 | 6/2009 | Arashima | |
| 2009/0243983 | A1* | 10/2009 | Ohashi et al. | 345/89 |
| 2011/0051006 | A1 | 3/2011 | Iisaka et al. | |

FOREIGN PATENT DOCUMENTS

| | | |
|---|---|---|
| CN | 102005193 A | 4/2011 |
| JP | A-06-034965 | 2/1994 |
| JP | A-2009-069608 | 4/2009 |
| JP | A-2009-169411 | 7/2009 |
| JP | A-2009-169412 | 7/2009 |

* cited by examiner

*Primary Examiner* — Jennifer Nguyen
(74) *Attorney, Agent, or Firm* — Oliff PLC

(57) ABSTRACT

A video processing includes: a boundary detecting section which respectively detects, in a current frame and a previous frame, a boundary between a first pixel in which the applied voltage designated by the video signal is lower than a first voltage and a second pixel in which the applied voltage is equal to or higher than a second voltage which is higher than the first voltage; and a correcting section which corrects the voltage applied to the liquid crystal element corresponding to at least one of the first pixel and the second pixel in positions between which a portion which moves from the boundary of the previous frame by one pixel is interposed, within the boundary of the current frame, to correct the input video signal in a direction where a transverse electric field generated in the first pixel and the second pixel is reduced.

15 Claims, 15 Drawing Sheets

SCANNING LINE DRIVING CIRCUIT

VIDEO PROCESSING CIRCUIT

PREVIOUS FRAME

CURRENT FRAME

CURRENT FRAME

<NORMALLY BLACK MODE>

NO CORRECTION PROCESS

CORRECTION PROCESS

PREVIOUS FRAME

CURRENT FRAME

CURRENT FRAME

PREVIOUS FRAME

CURRENT FRAME

CURRENT FRAME

PREVIOUS FRAME

CURRENT FRAME

CURRENT FRAME

<NORMALLY BLACK MODE>

NO CORRECTION PROCESS

CORRECTION PROCESS

PREVIOUS FRAME

CURRENT FRAME

CURRENT FRAME

<NORMALLY BLACK MODE>

NO CORRECTION PROCESS

CORRECTION PROCESS

NO CORRECTION PROCESS

CORRECTION PROCESS

VIDEO PROCESSING CIRCUIT, VIDEO PROCESSING METHOD, LIQUID CRYSTAL DISPLAY APPARATUS AND ELECTRONIC DEVICE

BACKGROUND

1. Technical Field

The present invention relates to a technique which reduces a display defect in a liquid crystal display panel.

2. Related Art

A liquid crystal display panel has a configuration in which pixel electrodes corresponding to pixels are arranged in a matrix shape on one of a pair of substrates and a common electrode is installed on the other thereof to be common over the respective pixels, and liquid crystal is interposed between the pixel electrodes and the common electrode. In such a configuration, if voltage according to a gray scale level is applied and held between the pixel electrodes and the common electrode, an orientation state of the liquid crystal is regulated for each pixel, and thus transmittance or reflectance is controlled. Thus, in this configuration, only a component in a direction from the pixel electrodes to the common electrode (or in a reverse direction), that is, in a direction perpendicular to a substrate surface (longitudinal direction), within an electric field acting on liquid crystal molecules, contributes to a display control.

However, in recent years as pixel pitch has become narrow for the purpose of miniaturization and high precision, an electric field has been generated between adjacent pixel electrodes, that is, in a direction parallel to a substrate surface (transverse direction), the affect of which cannot be neglected. For example, if a transverse electric field is applied to liquid crystal which is driven by a longitudinal electric field, such as a VA (Vertical Alignment) method or a TN (Twisted Nematic) method, an orientation error of the liquid crystal (reverse tilt domain) occurs, thereby causing a display defect.

In order to reduce the effect of the reverse tilt domain, there is for example proposed a technique of contriving a structure of a liquid crystal display panel, for example, by regulating the shape of a light blocking layer (opening section) over pixel electrodes (refer to JP-A-6-34965 (FIG. 1), for example), or a technique which determines that the reverse tilt domain occurs in a case where an average luminance value calculated from a video signal is equal to or smaller than a threshold and clips a video signal which is equal to or larger than a preset value (refer to JP-A-2009-69608 (FIG. 2), for example).

However, in the technique of reducing the reverse tilt domain by means of the structure of the liquid crystal display panel, the aperture ratio is easily decreased. Further, it is difficult to apply the technique to an existing liquid crystal display panel without contrivance of the structure. On the other hand, in the technique which clips the video signal which is equal to or larger than the preset value, the brightness of a displayed image is indiscriminately limited to the preset value.

SUMMARY

An advantage of some aspects of the invention is that it provides a technique which solves the above problems and reduces the reverse tilt domain.

According to an aspect of the invention, there is provided a video processing circuit which receives a video signal which designates voltage applied to a liquid crystal element for each pixel and regulates each voltage applied to the liquid crystal element on the basis of a corrected video signal, including: a boundary detecting section which respectively detects, in a current frame and a previous frame, a boundary between a first pixel in which the applied voltage designated by the video signal is lower than a first voltage and a second pixel in which the applied voltage is equal to or higher than a second voltage which is higher than the first voltage; and a correcting section which corrects the voltage applied to the liquid crystal element corresponding to at least one of the first pixel and the second pixel in positions between which a portion which moves from the boundary of the previous frame by one pixel is interposed, within the boundary of the current frame, to correct the input video signal in a direction where a transverse electric field generated in the first pixel and the second pixel is reduced. According to this aspect of the invention, it is not necessary to change the structure of the liquid crystal display panel, to thereby prevent reduction in the aperture ratio. Further, since it is not necessary to contrive the structure, it is possible to apply the invention to an existing liquid crystal display panel. According to this aspect of the invention, since only the transverse electric field between pixels in positions, between which the portion which moves from the boundary of the previous frame by one pixel is interposed, within the boundary of the current frame, is decreased, it is possible to suppress generation of the reverse tilt domain while reducing a portion (display departure) on which an image different from an image regulated by the video signal is displayed.

Here, in order to correct the input video signal in the direction where the transverse electric field generated in the first pixel or the second pixel in the positions between which the portion which moves from the boundary of the previous frame by one pixel is interposed, within the boundary of the current frame, is reduced, there are three methods of correcting the voltage applied to the liquid crystal element of the first pixel in a raised direction, correcting the voltage applied to the liquid crystal element of the second pixel in a lowered direction, and correcting the voltage applied to the liquid crystal element of the first pixel in a raised direction and correcting the voltage applied to the liquid crystal element of the second pixel in a lowered direction.

In this aspect of the invention, in a case where the first pixel and the second pixel in the positions between which the portion which moves from the boundary of the previous frame by one pixel is interposed, within the boundary of the current frame, are all the second pixels in the previous frame, the correcting section may exclude the first pixel and the second pixel in the positions between which the portion is interposed, from a correction target. With this exclusion, it is possible to reduce the pixel which becomes the display departure.

Further, in this aspect of the invention, the correcting section may correct, in a direction where the transverse electric field is reduced, the voltage applied to the liquid crystal element corresponding to one or more pixels which are adjacent, on the opposite side, to the first pixel or the second pixel adjacent to the portion which moves from the boundary of the previous frame by one pixel and continue in a direction away from the portion, within the boundary of the current frame. As the number of the corrected pixels is increased, it is possible to prevent the correction of the applied voltage from being noticeable.

In addition, the concept of the invention can be applied to a video processing method, a liquid crystal display apparatus and an electronic device having the liquid crystal display apparatus, in addition to the video processing circuit.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, preferred embodiments of the invention will be described with reference to the accompanying drawings.

Figure 1:
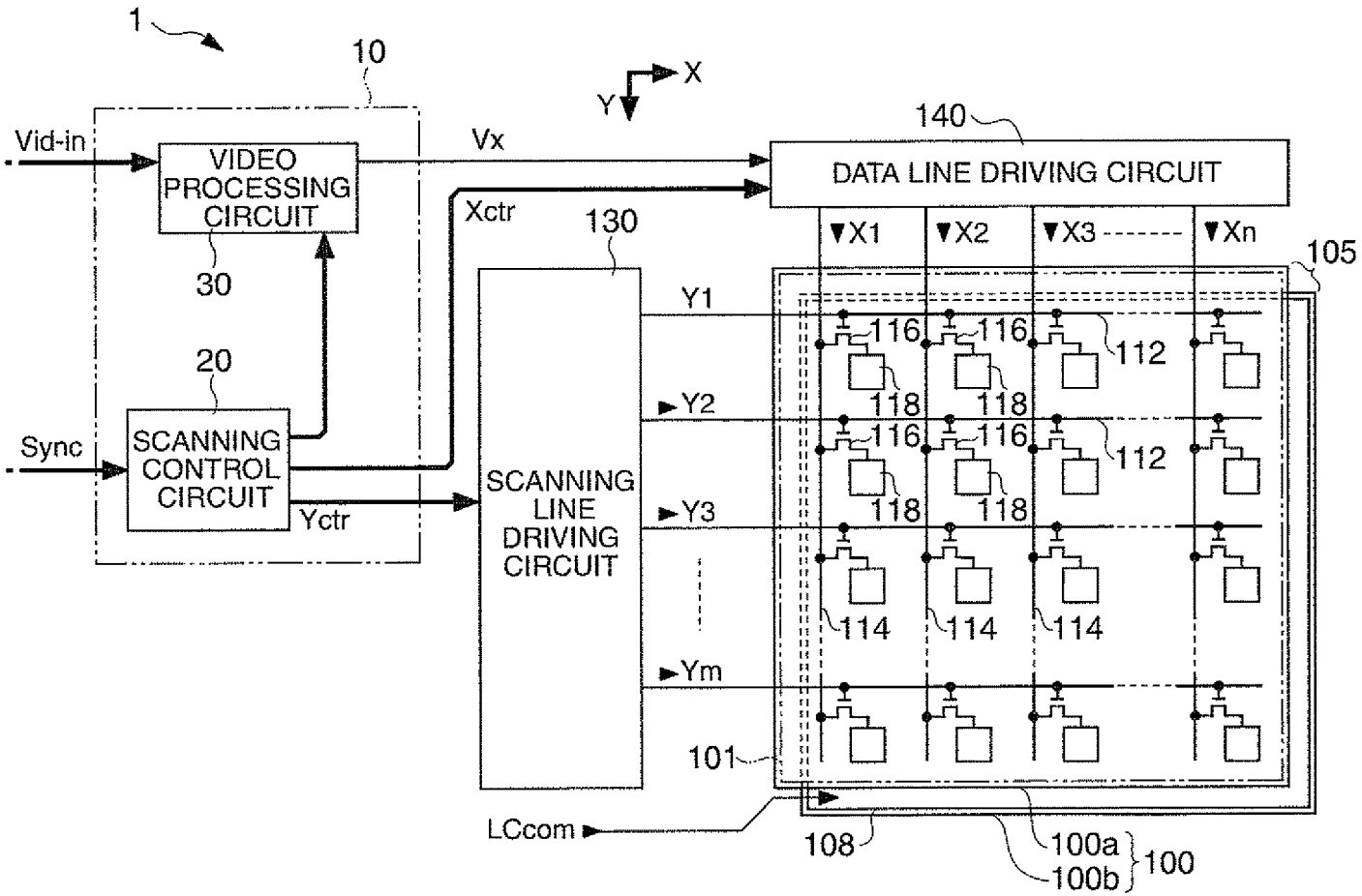
FIG. 1 is a diagram illustrating a liquid crystal display apparatus to which a video processing circuit according to an embodiment of the invention is applied.

FIG. 1 is a block diagram illustrating an overall configuration of a liquid crystal display apparatus to which a video processing circuit according to the embodiment of the invention is applied.

As shown in the figure, a liquid crystal display apparatus 1 includes a control circuit 10, a liquid crystal display panel 100, a scanning line driving circuit 130, and a data line driving circuit 140.

A video signal Vid-in is synchronized with a synchronization signal Sync from a higher-level device to be supplied to the control circuit 10. The video signal Vid-in is digital data which designates a gray scale level of each pixel in the liquid crystal display panel 100, and is supplied in the scanning order based on a vertical scanning signal, a horizontal scanning signal and a dot clock signal (which are not shown) which are included in the synchronization signal Sync.

The video signal Vid-in designates a gray scale level of a pixel. However, since voltage applied to a liquid crystal element is determined according to the gray scale level which will be described later, the video signal Vid-in may designate the voltage applied to the liquid crystal element.

The control circuit 10 includes a scan control circuit 20 and a video processing circuit 30. Here, the scan control circuit 20 generates a variety of control signals, and controls each section in synchronization with the synchronization signal Sync. The video processing circuit 30 processes the digital video signal Vid-in to output an analog data signal Vx, which will be described in more detail later.

The liquid crystal display panel 100 is configured so that an element substrate (first substrate) 100*a* and an opposite substrate (second substrate) 100*b* are adhered to each other with a constant gap and a liquid crystal 105 which is driven in a longitudinal electric field is interposed in the gap.

On a surface of the element substrate 100*a* facing the opposite substrate 100*b*, a plurality of scanning lines 112 having m rows is installed in an X (transverse) direction in the figure, and a plurality of data lines 114 having n columns is installed in an Y (longitudinal) direction to be electrically insulated from the respective scanning lines 112.

In this embodiment, the scanning lines 112 may be referred to as a first, a second, a third, . . . , an (m−1)-th, and an m-th scanning line, in the order from the top in the figure, for the convenience of clarity. Similarly, the data lines 114 may be referred to as a first, a second, a third, . . . , an (n−1)-th, and an n-th data line, in the order from the left in the figure, for the convenience of clarity.

In the element substrate 100*a*, a set of an n-channel TFT 116 and a rectangular and transparent pixel electrode 118 is installed corresponding to each of intersections between the scanning lines 112 and the data lines 114. A gate electrode of the TFT 116 is connected to the scanning line 112, a source electrode thereof is connected to the data line 114, and a drain electrode thereof is connected to the pixel electrode 118.

On the other hand, on a surface of the opposite substrate 100*b* facing the element substrate 100*a*, a transparent common electrode 108 is installed over an overall surface thereof. A voltage LCcom is applied to the common electrode 108 by a circuit (not shown).

In FIG. 1, the opposite surface of the element substrate 100*a* is a rear side of a piece of paper. Thus, each scanning line 112, data line 114, TFT 116 and pixel electrode 118 installed in the opposite surface should be indicated by dashed lines, but are indicated by solid lines for ease of understanding.

Figure 2:
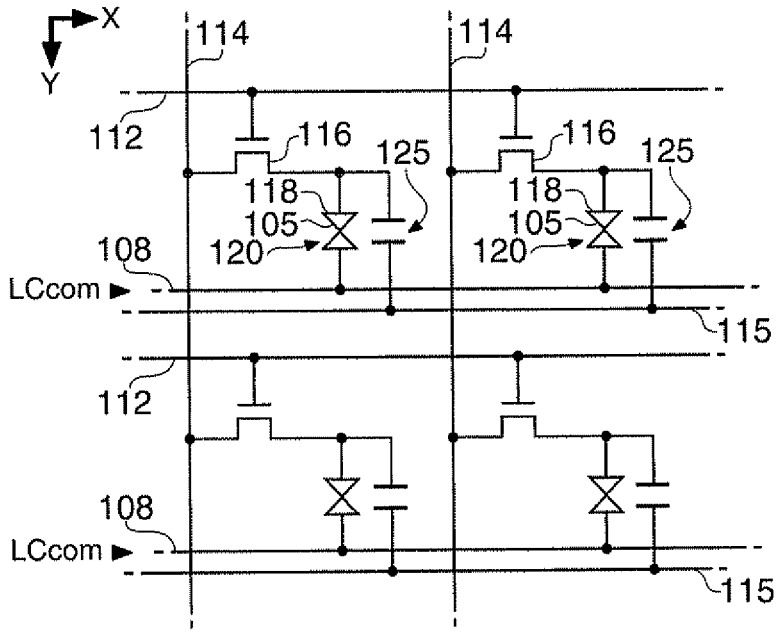
FIG. 2 is a diagram illustrating an equivalent circuit of a liquid crystal element in the liquid crystal display apparatus.

As shown in FIG. 2, an equivalent circuit of the liquid crystal display panel 100 is configured so that a liquid crystal display element 120 is arranged with the liquid crystal 105 being interposed between the pixel electrode 118 and the common electrode 108, corresponding to the intersection between the scanning line 112 and the data line 114.

Further, although not shown in FIG. 1, in the equivalent circuit of the liquid crystal display panel 100, as shown in FIG. 2, auxiliary capacitors (storage capacitors) 125 are actually installed in parallel with the liquid crystal elements 120. The auxiliary capacitor 125 includes one end connected to the pixel electrode 118, and the other end commonly connected to the capacitor line 115. A capacitor line 115 is held at a fixed voltage in a temporal manner.

In such a configuration, if the scanning line 112 is at a level H, the TFT 116 in which the gate electrode is connected to the scanning line is turned on, and the pixel electrode 118 is connected to the data line 114. Thus, when the scanning line 112 is at the level H, if a data signal of a voltage based on a gray scale is supplied to the data line 114, the data signal is applied to the pixel electrode 118 through the TFT 116 which has been turned on. If the scanning line 112 is at a level L, the TFT 116 is turned off. Here, the voltage applied to the pixel electrode is held by capacitance of the liquid crystal element 120 and the auxiliary capacitor 125.

In the liquid crystal element 120, a molecular orientation state of the liquid crystal 105 is changed according to an electric field generated between the pixel electrode 118 and the common electrode 108. Thus, the liquid crystal element 120 has, if it is a transmissive type, transmittance according to the applied and held voltage.

In the liquid crystal display panel 100, since the transmittance is changed according to each liquid crystal element 120, the liquid crystal element 120 corresponds to the pixel. Further, a pixel arrangement area corresponds to a display area 101. In the present embodiment, a state where the liquid crystal element 120 becomes black when no voltage is applied thereto is referred to as a normally black mode, when the liquid crystal 105 uses a VA method.

Figure 5A:
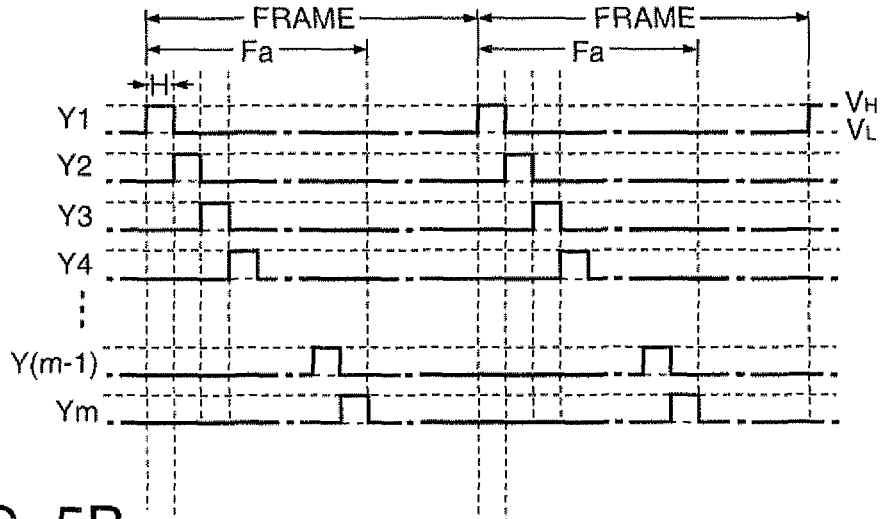
FIGS. 5A and 5B are diagrams illustrating a display operation in the liquid crystal display apparatus.

The scanning line driving circuit 130 supplies scanning signals Y1, Y2, Y3, . . . , and Ym to the first, second, third, . . . , and m-th scanning lines 112 according to a control signal Yctr by means of the scan control circuit 20. Specifically, as shown in FIG. 5A, the scanning line driving circuit 130 sequentially selects the first, second, third, . . . , (m−1)-th and m-th scanning lines 112 over a frame, and sets a scanning signal to the selected scanning line to a selected voltage $V_H$ (level H), and sets scanning signals to scanning lines other than the selected scanning line to a non-selected voltage $V_L$ (level L).

Here, the frame has a period while the video signals Vid-in are supplied corresponding to one video frame. If a frequency of a vertical scanning signal included in the synchronization signal Sync is 60 Hz, the frame has a period of 16.7 milliseconds which is its inverse number. In this embodiment, since the first, second, third, . . . , and m-th scanning lines 112 are sequentially selected over the frame, the liquid crystal display panel 100 is driven at a speed equivalent to the video signal Vid-in. Thus, in this embodiment, the period required for displaying images corresponding to one video frame on the liquid crystal display panel 100 coincides with the frame.

The data line driving circuit 140 samples a data signal Vx supplied from the video processing circuit 30 as data signals X1 to Xn according to a control signal Xctr from the scanning control circuit 20, to the first to n-th column data lines 114.

With respect to the voltage in this embodiment, a ground electric potential (not shown) is a reference of a zero voltage, unless particularly expressed, except the voltage applied to the liquid crystal element 120. The voltage applied to the liquid crystal element 120 is an electric potential difference between the voltage LCcom of the common electrode 108 and the pixel electrode 118, which is distinguished from other voltages. Further, in order to prevent deterioration of the liquid crystal 105 due to application of a direct current component, an alternating current driving method is performed in the liquid crystal element 120. Specifically, in the pixel electrode 118, a voltage Vcnt which is the center of amplitude is applied to the pixel electrode 118 for each frame, with a positive voltage of a higher level and a negative voltage of a lower level being alternatively switched with each other. For such an alternating current driving method, in this embodiment, a surface inversion method in which insertion polarities of the respective liquid crystal elements 120 in the same frame are all the same is used.

Figure 4A:
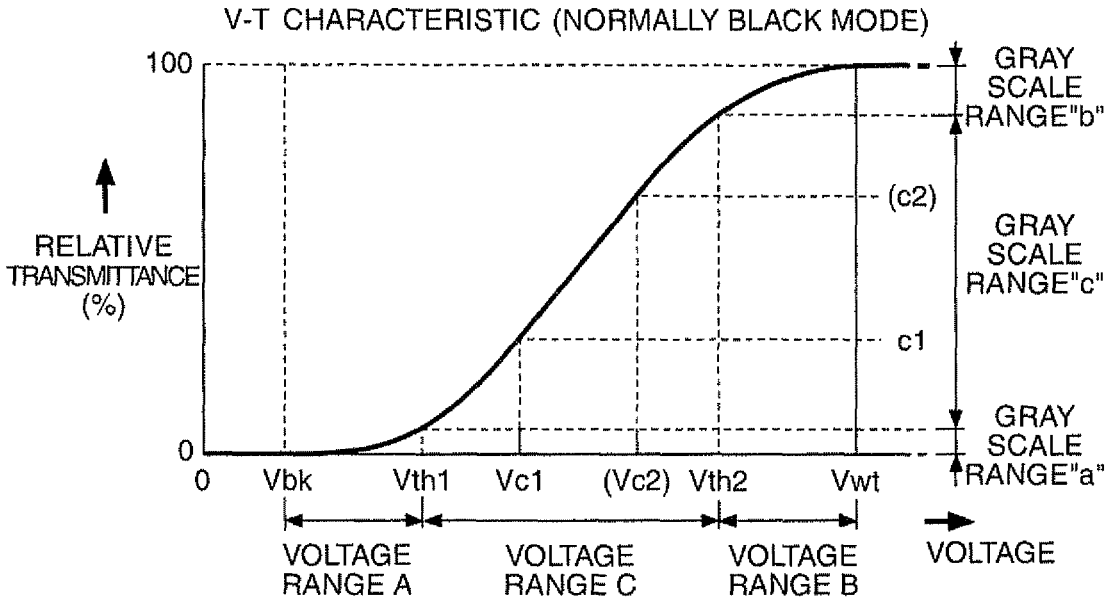
FIGS. 4A and 4B are diagrams illustrating a display characteristic in the liquid crystal display apparatus.

In this embodiment, the relationship between the applied voltage (V) and the transmittance (T) of the liquid crystal element 120 is indicated by a characteristic shown in FIG. 4A, since the liquid crystal 105 is in the normally black mode of the VA method. In order to allow the liquid crystal element 120 to have the transmittance according to the gray scale level designated in the video signal Vid-in, the voltage according to the gray scale level may be applied to the corresponding liquid crystal element.

However, if the applied voltage of the liquid crystal element 120 is merely regulated according to the gray scale level designated in the video signal Vid-in, a display defect may occur due to a reverse tilt domain.

Such a defect is affected by the transverse electric field when liquid crystal molecules interposed in the liquid crystal element 120 are in an unstable state. As a result, it is difficult to achieve the orientation state according to the applied voltage in the liquid crystal molecules.

If the voltage applied to the liquid crystal element 120 is in a voltage range A which is equal to or more than a voltage Vbk of a black level in the normally black mode and is less than a threshold voltage Vth1 (first voltage), a restraining force due to a longitudinal electric field slightly exceeds a restraining force due to an alignment film. Thus, it is likely that the orientation state of the liquid crystal molecules is affected. This causes the unstable state of the liquid crystal molecules.

For the sake of convenience, a transmittance range (gray scale range) of the liquid crystal element in which the applied voltage of the liquid crystal element is in the voltage range A is referred to as "a".

On the other hand, the effect of the transverse electric field occurs in a case where an electrical potential difference between pixel electrodes which are adjacent to each other increases, which is a case where a dark pixel of a black level or close to the black level in an image to be displayed, and a bright pixel of a white level or close to the white level are adjacent to each other.

Here, the dark pixel corresponds to the liquid crystal element 120 in which the applied voltage is in a voltage range A in the normally black mode as shown in FIG. 4A, and the bright pixel is obtained by assigning the transverse electric field to the dark pixel. In order to specify the bright pixel, the bright pixel corresponds to the liquid crystal element 120 in a voltage range B in which the applied voltage is equal to or more than a threshold voltage Vth2 (second voltage) and is equal to or less than a white level voltage Vwt in the normally black mode.

For the sake of convenience, a transmittance range (gray scale range) of the liquid crystal element in which the applied voltage of the liquid crystal element is in the voltage range B is referred to as "b".

In the normally black mode, the threshold voltage Vth1 may be an optical threshold voltage in which a relative transmittance of the liquid crystal element is set to 10%, and a threshold voltage Vth2 may be an optical saturation voltage in which a relative transmittance of the liquid crystal element is set to 90%.

The liquid crystal element in which the applied voltage is in the voltage range A easily undergoes a reverse tilt domain due to the transverse electric field when it is adjacent to the liquid crystal element in which the applied voltage is in the voltage range B.

On the other hand, even though the liquid crystal element in which the applied voltage is in the voltage range B is adjacent to the liquid crystal element in which the applied voltage is in the voltage range A, since it is mainly affected by its longitudinal electric field and is in a stable state, the reverse tilt domain hardly occurs like the liquid crystal element in which the applied voltage is in the voltage range A.

An example of the display defect due to the reverse tilt domain will be described. For example, in a case where an image displayed by the video signal Vid-in is shown in FIG. 15A, specifically, in a case where a dark pattern having continuous dark pixels of the gray scale range "a" moves in a left direction by one pixel for each frame using bright pixels of the gray scale range "b" as a background, a pixel, which should be changed from the dark pixel to the bright pixel in a right edge section of the dark pattern (rear edge section of the movement), does not become the bright pixel due to generation of the reverse tilt domain, which is actualized as a kind of trail phenomenon.

Here, as described in the present embodiment, in a case where the liquid crystal display panel 100 is driven at a speed equivalent to the supply speed of the video signal Vid-in, when an area of the dark pixel using the bright pixel as the background moves by two pixels or more for each frame, such a trail phenomenon is not actualized (or is hard to be visualized). The reason is as follows. That is, when a dark pixel and a bright pixel are adjacent to each other in a certain frame, the reverse tilt domain may occur in the bright pixel. However, considering that the movement of the image, since the pixels in which the reverse tilt domain occurs are discrete, they are not visually noticeable.

Figure 15A:
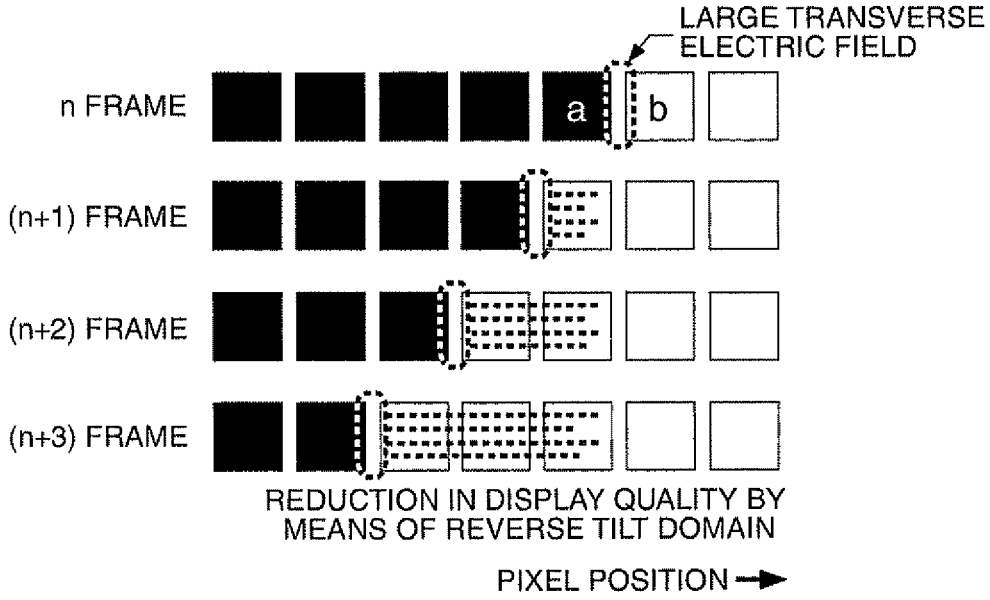
FIGS. 15A and 15B are diagrams illustrating an example of a display defect due to the influence of the transverse electric field.

In FIG. 15A, if a perspective is changed, in a case where a bright pattern having continuous bright pixels moves in the left direction by one pixel for each frame using the dark pixel as the background, a pixel, which should be changed from the dark pixel to the bright pixel in the left edge section of the bright pattern (leading edge section of the movement), may not become the bright pixel due to generation of the reverse tilt domain.

Further, in the same figure, for the convenience of description, a boundary area of one line within the image is extracted.

Here, the reverse tilt domain may be easily generated in the following conditions:

(1) in a case where the dark pixel of the gray scale range "a" and the bright pixel of the gray scale range "b" are adjacent to each other in the image displayed by the video signal Vid-in of a certain frame, (2) when a boundary indicating a portion where the dark pixel and the bright pixel are adjacent to each other moves by one pixel from the previous frame, (3) in the pixel in which the applied voltage should be lowered among the dark pixel and the bright pixel adjacent to the boundary (dark pixel in the normally black mode).

The main reason that the reverse tilt domain is generated is the transverse electric field as described above. Thus, if a countermeasure that a strong transverse electric field is not generated in a boundary satisfying the above conditions (1) and (2) is provided, it is possible to suppress generation of the reverse tilt domain in the condition (3).

In such a perspective, in this embodiment, as shown in FIG. 1, the video processing circuit 30 is installed on an upstream side of the liquid crystal display panel 100 in a supply path of the video signal Vid-in and then performs the following process. That is, the video processing circuit 30 analyzes the image displayed by the video signal Vid-in, and detects the boundary where the dark pixel of the gray scale range "a" and the bright pixel of the gray scale range "b" are adjacent to each other. Within the detected boundary, a boundary which moves by one pixel from a boundary prior to one frame is extracted. Then, a process of replacing a gray scale level of a pixel (dark pixel in the normally black mode) in which the applied voltage should be lowered with a gray scale level "c1" which belongs to a different gray scale range "c" which is not the gray scale range "b" from the gray scale range "a", among the dark pixel and the bright pixel adjacent to the extracted boundary (application boundary), is performed.

Accordingly, in the liquid crystal display panel 100, since a voltage Vc1 corresponding to the gray scale level c1 is applied to the liquid crystal element 120 relating to the dark pixel, the strong transverse electric field is not generated in the application boundary.

Figure 3:
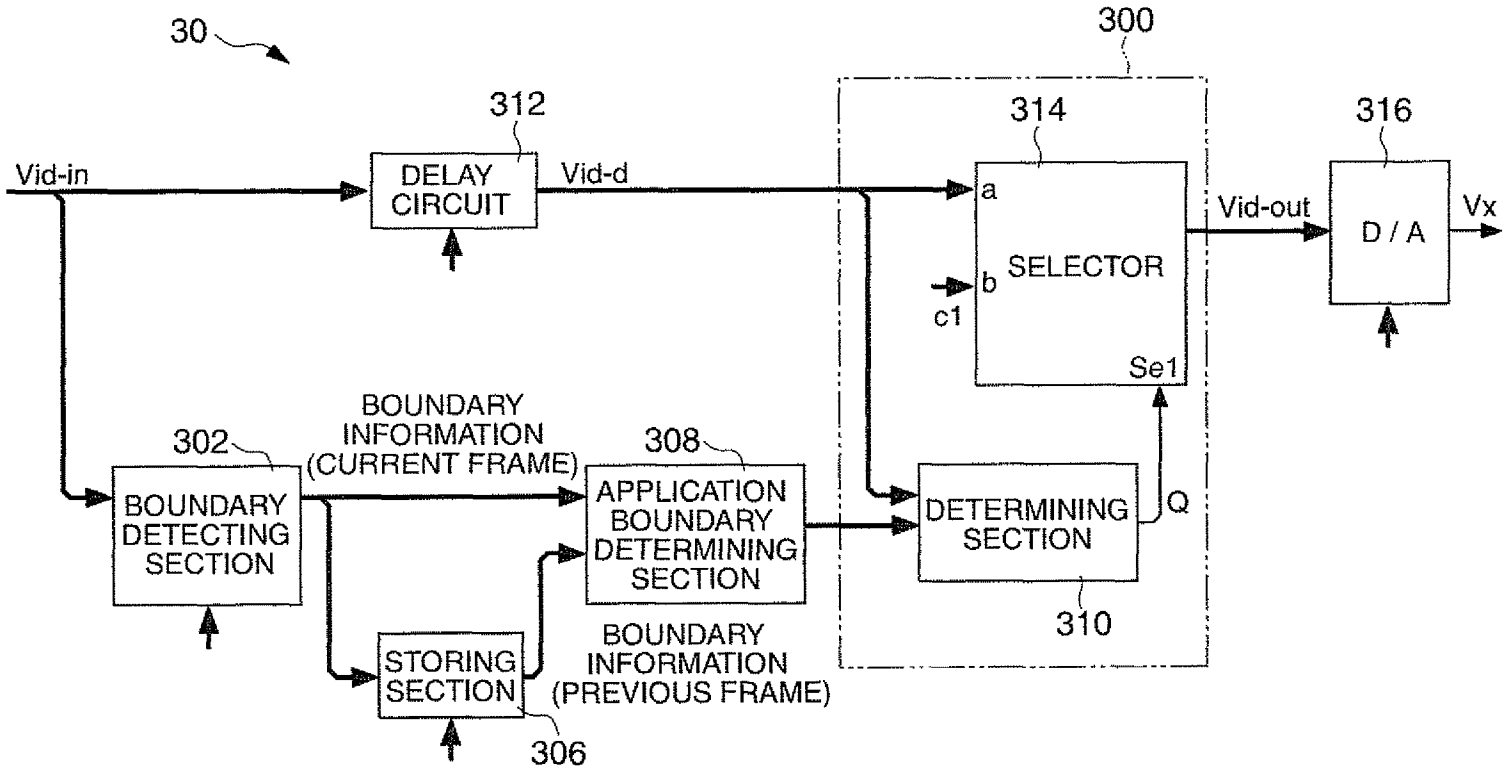
FIG. 3 is a diagram illustrating a configuration of the video processing circuit.

Next, details of the video processing circuit 30 will be described with reference to FIG. 3. As shown in the figure, the video processing circuit 30 includes a correcting section 300, a boundary detecting section 302, a storing section 306, an application boundary determining section 308, a delay circuit 312, and a D/A converter 316.

Here, the delay circuit 312 accumulates a video signal Vid-in supplied from a higher-level device, reads the video signal after a predetermined time elapses, and outputs the video signal as a video signal Vid-d. The delay circuit 312 includes a FIFO (fast in fast out) memory, a multi-stage latch circuit, or the like. The accumulation or reading in the delay circuit 312 is controlled by the scan control circuit 20.

In this embodiment, the boundary detecting section 302 analyzes the image displayed by the video signal Vid-in, detects a boundary where the pixel in the gray scale range "a" and the pixel in the gray scale range "b" are adjacent to each other, and outputs boundary information indicating the boundary.

Here, the boundary refers to a portion where the pixel in the gray scale range "a" and the pixel in the gray scale range "b" are adjacent to each other. Thus, for example, a portion where the pixel in the gray scale range "a" and the pixel in the gray scale range "c" are adjacent to each other, or a portion where the pixel in the gray scale range "b" and the pixel in the gray scale range "c" are adjacent to each other is not treated as a boundary.

Further, since the video signal Vid-in (Vid-d) is an image to be displayed, the frame of the image displayed by the video signal Vid-in (Vid-d) may be referred to as a current frame.

On the other hand, the storing section 306 stores information about a boundary output by the boundary detecting section 302, and outputs the stored boundary information after one frame elapses. Accordingly, information about a boundary prior to one frame, other than information about a boundary of the current frame output from the boundary detecting section 302, is output from the storing section 306.

The storage and output of the information in the storing section 306 are controlled by the scan control circuit 20.

The application boundary determining section 308 determines, as the application boundary, a portion which moves by one pixel in up, down, left and right directions from the boundary of the previous frame output from the storing section 306, within the boundary of the current frame output from the boundary detecting section 302, and outputs information about the determined application boundary.

Since the application boundary refers to a boundary which moves by one pixel from the boundary of the image displayed by the video signal of the previous frame, within the boundary of the image displayed by the video signal of the current frame, a boundary which does not move from the previous frame and a boundary which moves by two pixels or more are not treated as the application boundary.

The correcting section 300 includes a determining section 310 and a selector 314. Here, the determining section 310 determines whether the pixel indicated by the video signal Vid-d which is delayed by the delay circuit 312 is adjacent to the application boundary determined by the application boundary determining section 308 (first determination), and determines whether the gray scale level of the corresponding pixel belongs to the gray scale range "a" (second discrimination), respectively. If the discrimination results are all "Yes", a flag Q of an output signal is set to "1", for example, and if any one of the discrimination results is "No", the flag Q is set to "0".

If video signals of pixels corresponding to at least a plurality of rows are not stored, the boundary detecting section 302 cannot detect the boundary in the image to be displayed, and thus, the delay circuit 312 is installed to adjust a supply timing of the video signal Vid-in. Thus, since a timing of the video signal Vid-in supplied from the higher-level device is different from a timing of the video signal Vid-d supplied from the delay circuit 312, strictly speaking, horizontal scanning periods or the like thereof do not coincide with each other, which will be described hereinafter without particular discrimination.

The selector 314 selects any one of input terminals "a" and "b" according to the flag Q supplied to a control terminal Sel, and outputs a video signal Vid-out through an output terminal Out, from a signal supplied to the selected input terminal. Specifically, in the selector 314, the video signal Vid-d by means of the delay circuit 312 is supplied to the input terminal "a", and a video signal of the gray scale level c1 is supplied to the input terminal "b" for replacement. Further, if the flag Q supplied to the control terminal Sel is "1", the selector 314 selects the input terminal "b", and if the flag Q is "0", the selector 314 outputs the video signal Vid-d supplied to the input terminal "a" as the video signal Vid-out.

The D/A converter 316 converts the video signal Vid which is digital data into an analog data signal Vx. As described above, in this embodiment, since the surface inversion method is employed, the polarity of the data signal Vx is switched for each frame.

The voltage LCcom applied to the common electrode 108 may be approximately the same voltage as the voltage Vcnt, and may be adjusted to be lower than the voltage Vcnt in consideration of off-leakage or the like of the n channel TFT 116.

In such a configuration, if the flag Q is "1", this means that the pixel displayed by the video signal Vid-in is adjacent to the application boundary and the gray scale level of the corresponding pixel is included in the gray scale range "a". If the flag Q is "1", since the selector 314 selects the input terminal "b", the video signal Vid-d which designates the gray scale level of the gray scale range "a" is replaced by a video signal which designates the gray scale level "c1" and is output as the video signal Vid-out.

On the other hand, if the flag Q is "0", since the selector 314 selects the input terminal "a", the delayed video signal Vid-d is output as the video signal Vid.

A display operation of the liquid crystal display apparatus 1 will be described. The video signal Vid-in is supplied from the higher-level device, in the pixel order of 1×1 to 1×n, 2×1 to 2×n, 3×1 to 3×n, . . . , and m×1 to m×n over the frame. The video processing circuit 30 performs a process such as delay and replacement of the video signal Vid-in and outputs the video signal Vid-out.

Figure 5B:
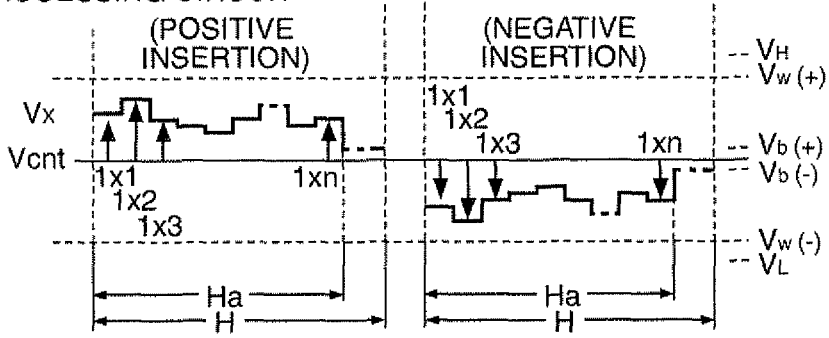

Here, in view of a horizontal effective scanning period (Ha) while the video signal Vid-out of 1×1 to 1×n is output, the processed video signal Vid is converted into a positive or negative data signal Vx as shown in FIG. 5B, using the D/A converter 316, and for example, is converted into the positive polarity therein. The data signal Vx is sampled as data signals X1 to Xn by the data line driving circuit 140, to the first to n-th column data lines 114.

On the other hand, in the horizontal scanning period while the 1×1 to 1×n, video signals Vid-out are output, the scanning control circuit 20 performs control so that only the scanning signal Y1 is at a level H with respect to the scanning line driving circuit 130. If the scanning signal Y1 is at the level H, the first row TFT 116 is turned on. Thus, the data signal sampled to the data line 114 is applied to the pixel electrode 118 through the TFT 116 which is in the turned on state. Accordingly, a positive voltage according to each gray scale level designated by the video signal Vid-out is inserted to the 1×1 to 1×n liquid crystal elements.

Subsequently, the 2×1 to 2×n video signals Vid-in are processed by the video processing circuit 30 in a similar way and are output as the video signals Vid-out, are converted into positive data signals by the D/A converter 316, and then are sampled to the first to n-th column data lines 114 by the data line driving circuit 140.

At the horizontal scanning period while the 2×1 to 2×n video signals Vid-out are output, since only the scanning signal Y2 is at the level H by the scanning line driving circuit 130, the data signal sampled to the data line 114 is applied to the pixel electrode 118 through the TFT 116 of the second row which is in the turned-on state. Thus, the positive voltage according to each gray scale level designated by the video signals Vid-out is inserted to the 2×1 to 2×n liquid crystal elements.

A similar insertion operation is performed with respect to the third, fourth, . . . , and m-th rows. Thus, the voltage according to the gray scale level designated by the image signal. Vid-out is inserted to each liquid crystal element to create a transmission image designated by the video signal Vid-in.

In the next frame, the same insertion operation is performed except that the video signal Vid-out is converted into a negative data signal by polarity inversion of the data signal.

FIG. 5B is a voltage waveform diagram illustrating an example of a data signal Vx at the time when the 1×1 to 1×n video signals Vid-out are output over the horizontal scanning period (H) from the video processing circuit 30. In this embodiment, since the normally black mode is employed, if the data signal Vx is positive, the data signal Vx becomes a voltage (indicated as ↑ in the figure) of a high level with reference to the amplitude center voltage Vcnt, as the gray scale level processed by the video processing circuit 30 becomes bright. Further, if the data signal Vx is negative, the data signal Vx becomes a voltage (indicated as ↓ in the figure) of a low level with reference to the voltage Vcnt, as the gray scale level becomes bright.

Specifically, the voltage of the data signal Vx becomes a voltage which is shifted by an amount according to the gray scale from the reference voltage Vcnt in a range from a voltage Vw(+) corresponding to white to a voltage Vb(+) corresponding to black if the voltage is positive, and in a range from a voltage Vw(−) corresponding to white to a voltage Vb(−) corresponding to black if the voltage is negative, respectively.

The voltage Vw(+) and the voltage Vw(−) are in a symmetric relationship with reference to the voltage Vcnt. The voltages Vb(+) and Vb(−) are also in a symmetric relationship with reference to the voltage Vcnt.

FIG. 5B illustrates a voltage waveform of the data signal Vx, which is different from a voltage (electric potential difference between the pixel electrode 118 and the common electrode 108) applied to the liquid crystal element 120. Further, a longitudinal scale of the voltage of the data signal in FIG. 5B is enlarged compared with a voltage waveform such as a scanning signal in FIG. 5A.

Subsequently, a specific example of the process in the video processing circuit 30 will be described.

Figure 6A:
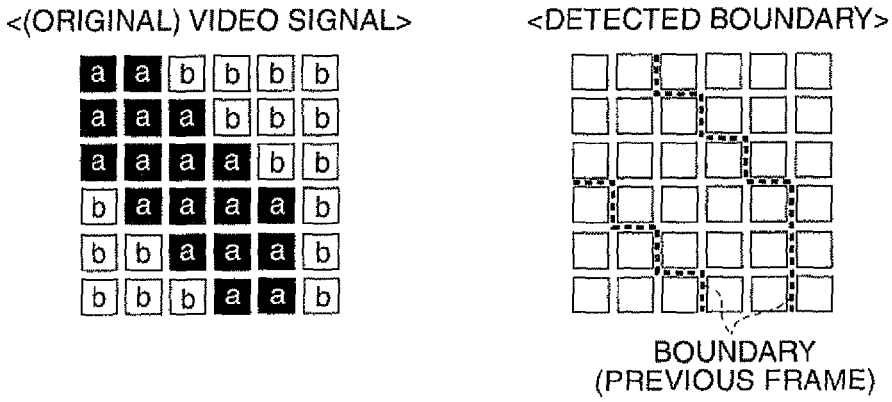
FIGS. 6A to 6C are diagrams illustrating content of a correction process (one pixel) in the video processing circuit.
Figure 6B:
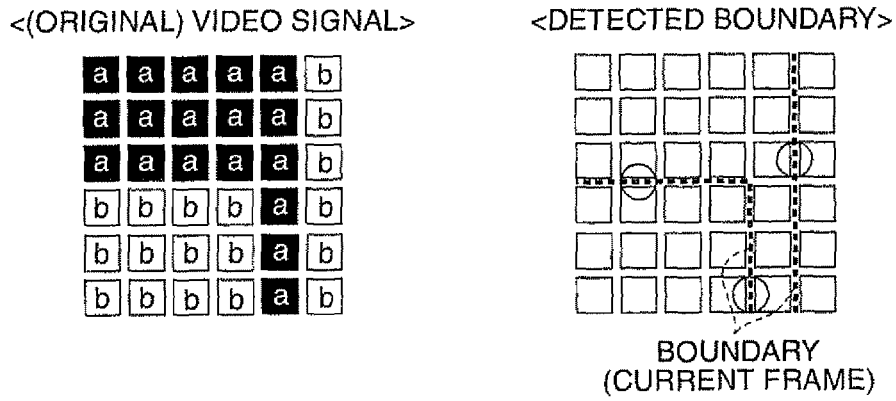

In a case where a part of the image of the current frame displayed by the video signal Vid-in is illustrated in a left section in FIG. 6B, for example, a boundary detected by the boundary detecting section 302 is indicated by a dashed line in a right section in FIG. 6B.

On the other hand, in a case where an image prior to one frame in the same portion is illustrated in a left section in FIG. 6A, for example, a boundary output from the storing section 306 is indicated by a dashed line in a right section in FIG. 6A.

The application boundary determining section 308 outputs a portion (surrounded by a circle) in which one pixel moves from a boundary prior to one frame shown in FIG. 6A, within the boundary detected in the right section in FIG. 6B as an application boundary.

Figure 6C:
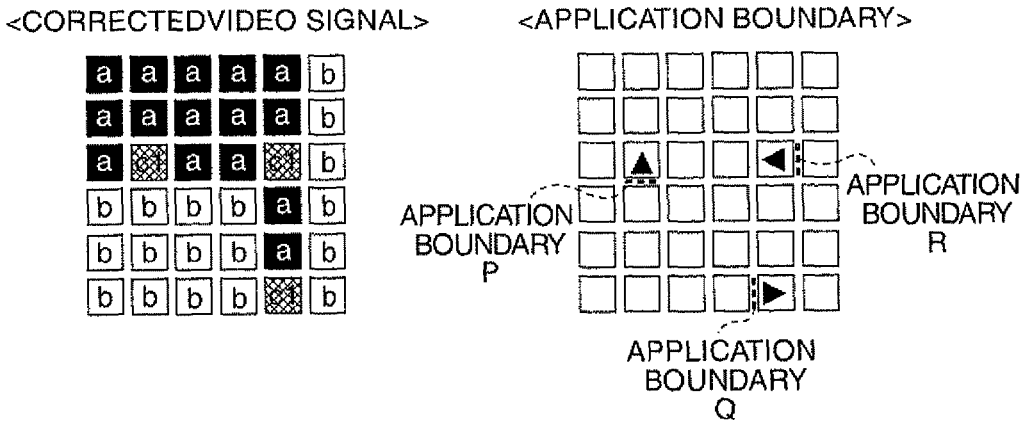

In this example, the application boundary portions are three in number as shown in the right section in FIG. 6C, which are application boundaries P, Q and R as shown in the same figure, in order to distinguish them from each other.

In the selector 314, since the dark pixel which belongs to the gray scale range "a", among the pixels adjacent to the application boundary, is replaced by the video signal of the gray scale level "c1", the image shown in the left section in FIG. 6B is corrected into a gray scale level as shown in the left section in FIG. 6C. Specifically, a dark pixel positioned on the upper side with reference to the application boundary P, a dark pixel positioned on the right side with reference to the application boundary Q, and a dark pixel positioned on the left side with reference to the application boundary R are replaced by the gray scale level "c1", respectively.

Figure 7A:
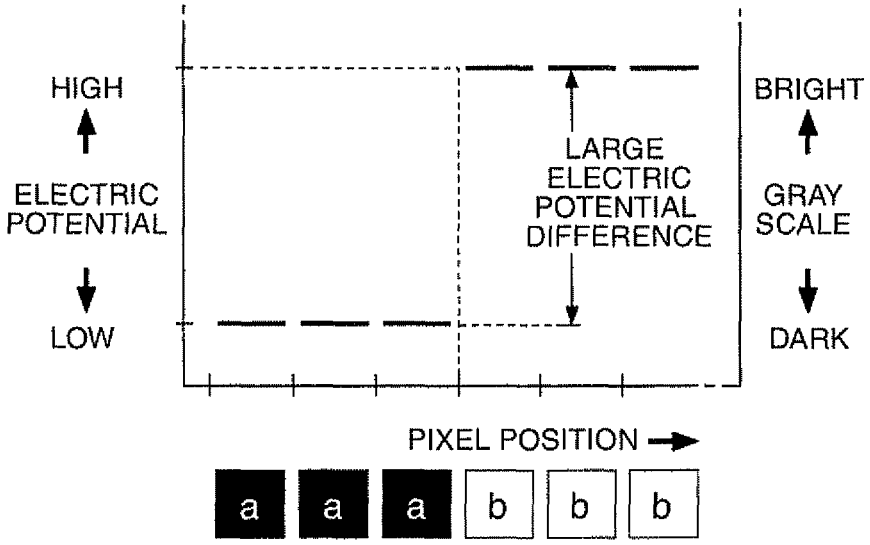
FIGS. 7A and 7B are diagrams illustrating reduction in a transverse electric field according to the correction process (one pixel).

If the video signal Vid-in is supplied to the liquid crystal display panel 100 in a state where the video signal Vid-in is not processed in the video processing circuit 30, in the dark pixel which belongs to the gray scale range "a" and the bright pixel which belongs to the gray scale range "b", the electric potential of the pixel electrode is as shown in FIG. 7A, if it is positive insertion. The electric potential of the pixel electrode of the dark pixel becomes, if it is positive insertion, lower than the electric potential of the pixel electrode of the bright pixel, but since the electric potential difference is large, it is easily affected by the transverse electric field.

If it is negative, the relationship in height of the electric potential is reversed, but the large electric potential difference is not changed, and thus, it is also easily affected by the transverse electric field.

Figure 7B:
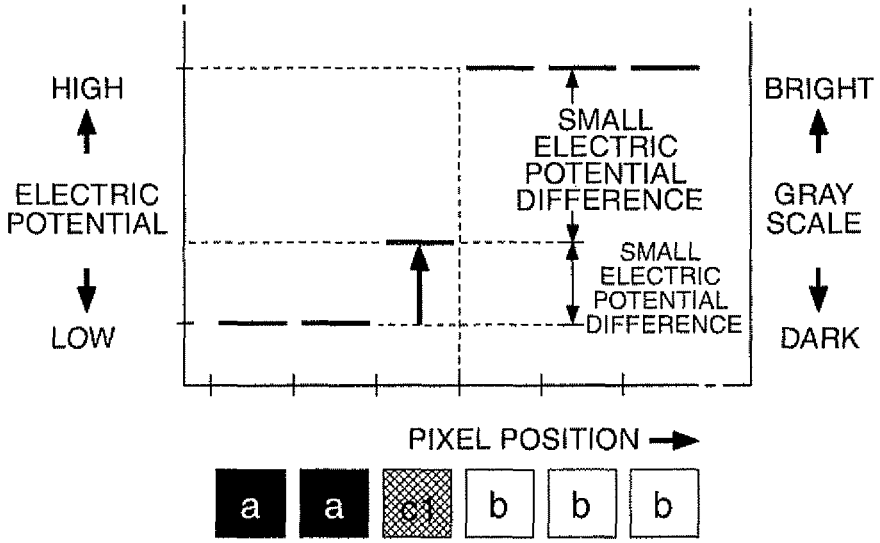

On the other hand, in this embodiment, the application boundary is determined from the boundary where the dark pixel which belongs to the gray scale range "a" and the bright pixel which belongs to the gray scale range "b" are adjacent to each other, and the video signal Vid-out corresponding to the dark pixel adjacent to the application boundary is replaced by the gray scale level "c1". Thus, the voltage applied to the liquid crystal element of the dark pixel is increased. In other words, if the electric potential of the pixel electrode of the dark pixel is positive insertion, as shown in FIG. 7B, the voltage is raised.

Figure 15B:
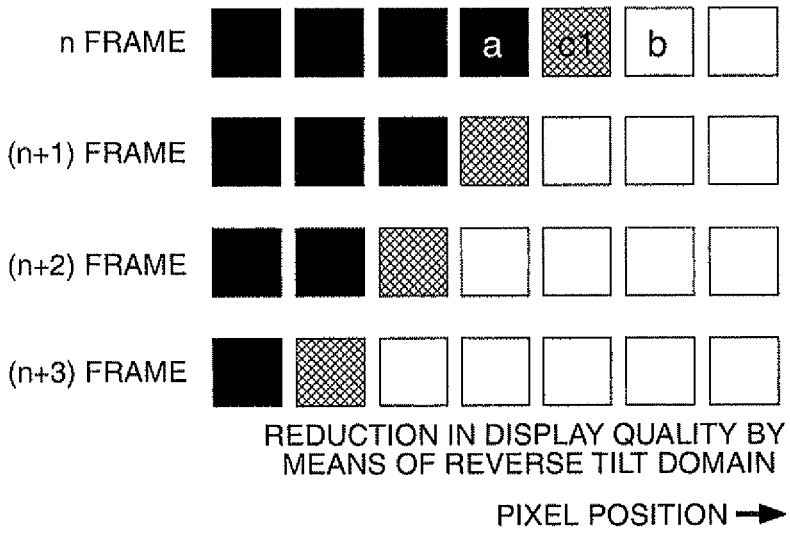

Thus, in the image displayed by the video signal Vid-in, the dark pixel is not directly changed to the bright pixel, as shown in FIG. 15B, but is changed to the bright pixel passing through the gray scale level "c1" once, in the liquid crystal display panel 100, even in a case where a portion, in which the black pixel is changed to the white pixel, moves by one pixel, as shown in FIG. 15A.

Accordingly, in this embodiment, since the size of the transverse electric field is changed by stages, and a large transverse electric field is prevented from being applied in the application boundary, it is possible to suppress generation of the display defect due to the reverse tilt domain.

Further, in this embodiment, the application boundary includes only a portion which moves by one pixel from the boundary of the previous frame, within the boundary where the dark pixel which belongs to the gray scale range "a" and the bright pixel which belongs to the gray scale range "b" are adjacent to each other, in the image of the current frame displayed by the video signal Vid-in. Thus, in this embodiment, compared with the configuration in which pixels adjacent to the boundary in the current frame are used as correction (replacement) targets, the pixel (display departure pixel), in which the gray scale level designated by the original video signal Vid-in is replaced by the gray scale level "c1" which is different from the gray scale level designated by the original video signal Vid-in, is suppressed at a low level.

In this way, according to this embodiment, it is possible to prevent in advance generation of the display defect due to the above-described reverse tilt domain. Further, since the gray scale level of the pixel adjacent to the application boundary is locally replaced among images regulated by the video signal Vid-in, there is little possibility that change in the display image due to the replacement is perceived by a user. In addition, in this embodiment, since it is not necessary to change the structure of the liquid crystal display panel 100, reduction in aperture ratio does not occur, and it is possible to apply the invention to existing liquid crystal display panels without contriving a new structure.

Application and Modification of the Embodiment

With respect to the above-described embodiment, a variety of applications and modifications can be achieved.

Example 1

Number of Pixels to be Changed

In the embodiment, only one dark pixel adjacent to the application boundary is replaced by the gray scale level "c1". In such a configuration, in order to decrease the transverse electric field generated in the application boundary between the dark pixel and the bright pixel, it is preferable to increase the raising amount of the voltage applied to the dark pixel adjacent to the application boundary. However, if the raising amount (correction amount) of the applied voltage increases, this causes discrepancy with the original image and the display departure.

Accordingly, in a case where the dark pixels are continuous, in addition to the dark pixel adjacent to the application boundary, with respect to K dark pixels (K is an integer which is equal to or more than 1) which continue in a direction (direction perpendicular to the application boundary) away from the application boundary to the dark pixel, gray scale levels thereof may be changed.

To this end, the determining section 310 may output the flag Q as "1" in the following case. Specifically, in a case where the gray scale level of the pixel displayed by the video signal Vid-d belongs to the gray scale range "a", pixels from the application boundary to the pixel displayed by the video signal Vid-d are continuous in the gray scale range "a", and the distance from the application boundary to the pixel displayed by the video signal Vid-d is within (K+1) pixels, the flag Q may be output as "1".

The number of pixels which are replacement candidates is preferably 2 to 10 or so including the pixel adjacent to the application boundary.

Figure 8A:
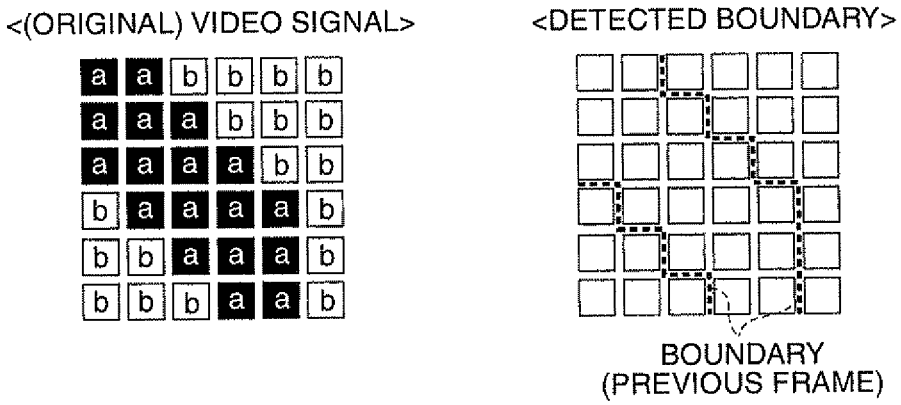
FIGS. 8A to 8C are diagrams illustrating content of a correction process (two pixels) according to an embodiment of the invention.
Figure 8B:
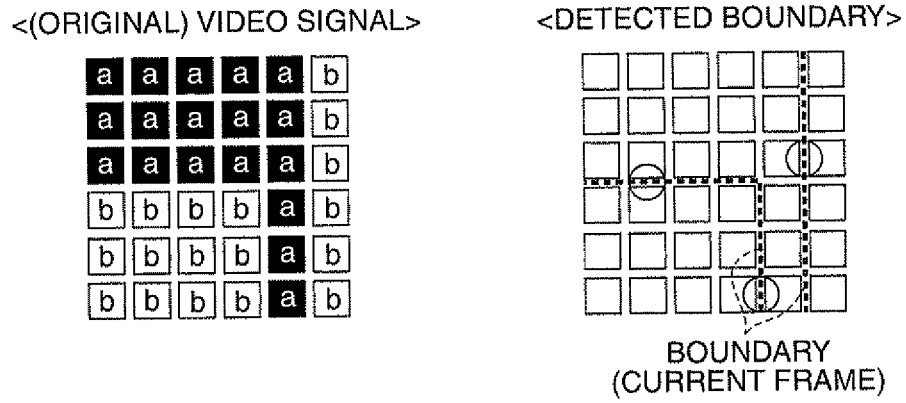
Figure 8C:
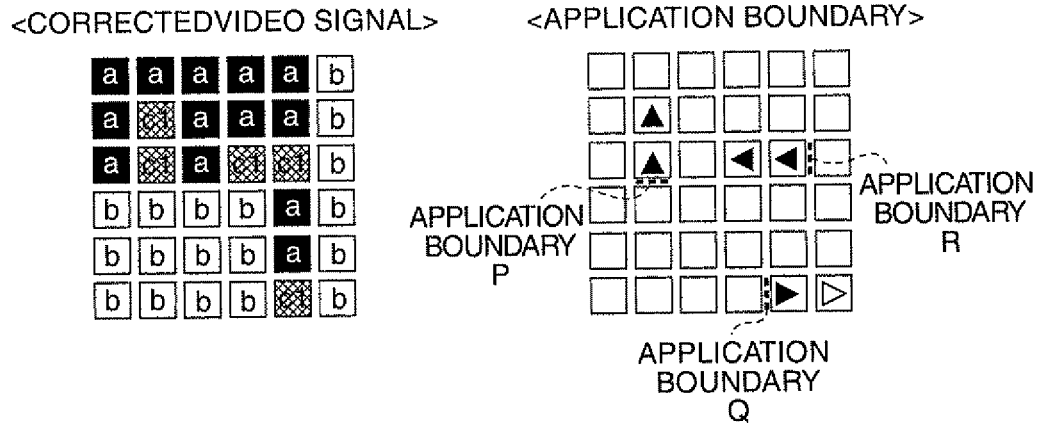

FIGS. 8A and 8C are diagrams illustrating a processing example in a case where gray scale levels of total two pixels of one dark pixel adjacent to the application boundary and a dark pixel adjacent to the dark pixel adjacent to the application boundary are replaced. Images of a previous frame and a current frame, a detected boundary and an application boundary are the same as in the example in FIGS. 6A and 6C. However, in this example, dark pixels positioned within two pixels in an upward direction from the application boundary P are replaced by the gray scale level "c1", respectively. That is, a total of two pixels, a dark pixel adjacent to the application boundary P and a dark pixel which is upwardly adjacent thereto, are replaced by the gray scale level "c1", respectively. Similarly, a total of two pixels, a dark pixel adjacent to the application boundary Q and a dark pixel which is leftward adjacent thereto, are replaced by the gray scale level "c1", respectively. However, since the dark pixel adjacent to the application boundary R is not extended in the right direction, only the dark pixel adjacent to the application boundary R is replaced by the gray scale level "c1".

In this way, if the gray scale levels of the pixel adjacent to the application boundary and at least one pixel adjacent thereto in a direction away from the application boundary are changed, even though the correction amount is not large, it is possible to reduce the transverse electric field.

Example 2

Another Example of Application Boundary

In the embodiment, the boundary where the dark pixel of the gray scale range "a" and the bright pixel of the gray scale range "b" are adjacent to each other is detected, and the boundary which moves from the boundary prior to one frame by one pixel, within the detected boundary, is set as the application boundary. The following three patterns are considered as this application boundary, in consideration of the change to the current frame from the previous frame. That is, in a case where the dark pixel and the bright pixel are adjacent to each other in the current frame, there are three cases, that is, a case where the two pixels are all dark pixels in the previous frame (pattern 1), a case where the two pixels are all bright pixels in the previous frame (pattern 2), and a case where two pixels which have been the bright pixel and the dark pixel in the previous frame are changed to be in the opposite state in the current frame (pattern 3).

As described with reference to FIG. 15A, as inferred from the above-described condition (3), when the dark pixel and the bright pixel are adjacent to each other in the previous frame, the reverse tilt domain easily occurs when a pixel (pixel in which liquid crystal molecules are in an unstable state) having low applied voltage is changed in a direction where the applied voltage is high in the current frame.

Accordingly, it can be understood that the effect of the reverse tilt domain lessens although the pattern 2 is excluded from the application boundary determined in the above-described embodiment. The reason is as follows: the pattern 2 corresponds to a case where two pixels are bright pixels in which liquid crystal molecules are in a stable state in the previous frame and any one of the bright pixels is replaced by a dark pixel by the movement of the image pattern, and thus, the reverse tilt domain hardly occurs in either of the two pixels.

In the embodiment, the application boundary determining section 308 detects the boundary where the dark pixel and the bright pixel are adjacent to each other in the current frame, and determines the boundary which moves from the boundary prior to one frame by one pixel, within the detected boundary, as the application boundary. However, at the time of determination of the application boundary, when the dark pixel and the bright pixel in the current frame were all bright pixels in the previous frame, if a configuration in which they are not determined as the application boundary is used, the pixel of the pattern 2 is excluded from the correction target.

Figure 9A:
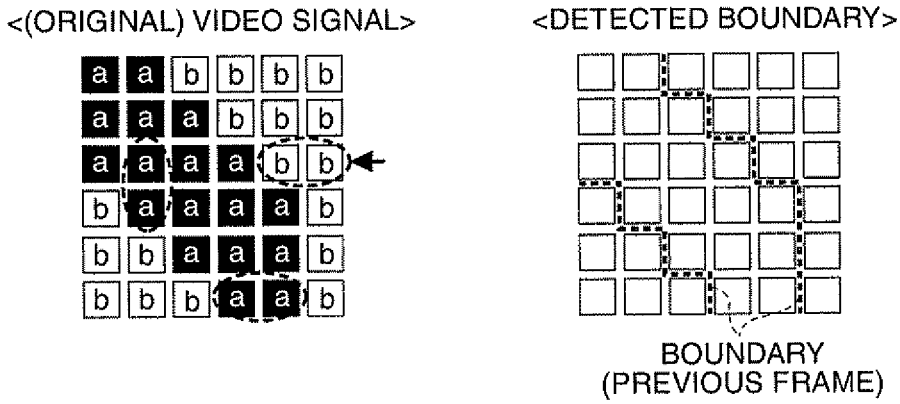
FIGS. 9A to 9C are diagrams illustrating content of another correction process according to an embodiment of the invention.
Figure 9B:
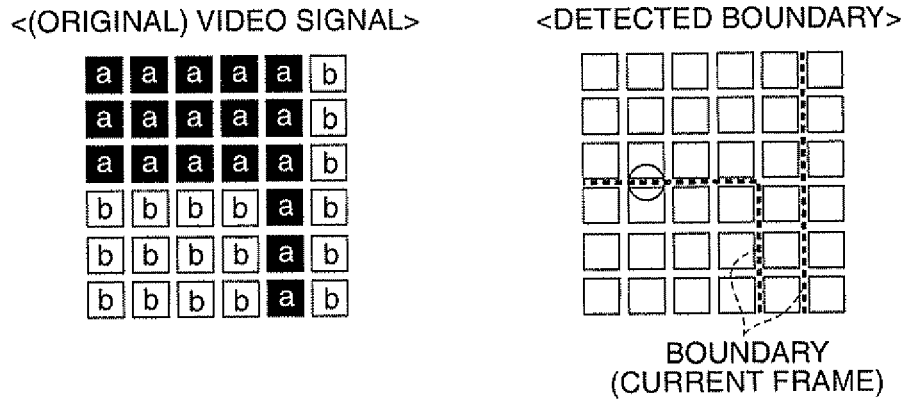
Figure 9C:
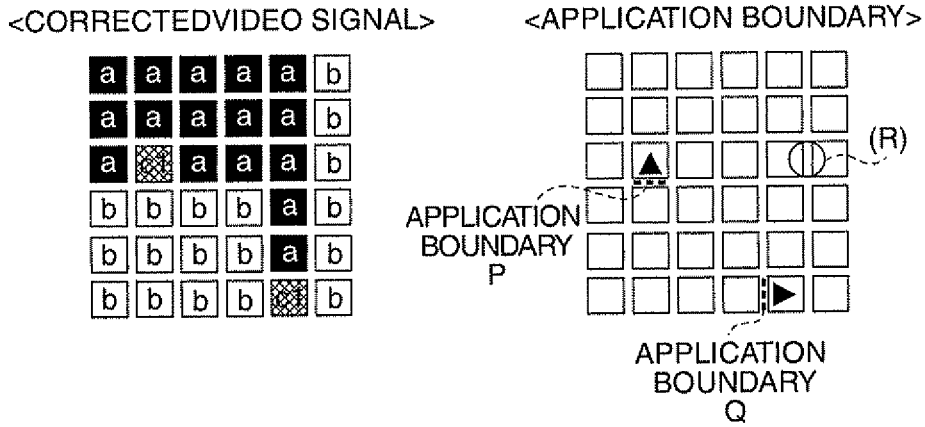

FIGS. 9A and 9C are diagrams illustrating a processing example of a case where the pattern 2 is excluded from the application boundary. Images of a previous frame and a current frame, a detected boundary are the same as in the example in FIGS. 6A and 6C. In the example in FIGS. 6A and 6C, the boundaries 2, Q and R are all determined as the application boundaries. However, in this example, since two pixels between which the boundary R is interposed are all bright pixels in the previous frame, they are excluded from the correction target.

If the pattern 2 is excluded in this way, it is possible to further reduce a pixel which is a display departure.

With respect to the pattern 2, a perspective may be changed. In this case, a pattern including bright pixels (pixels having higher voltage) moves toward a pattern including dark pixels (pixels having lower voltage).

Example 3

Pixel which is Replacement Target

In the embodiment, the dark pixel is replaced by the gray scale level "c1", among the dark pixel and the bright pixel between which the application boundary is interposed. This is because a pixel in which liquid crystal molecules are in an unstable state since the voltage applied to the liquid crystal element is low in the normally black mode is a dark pixel.

On the other hand, in order to suppress generation of the reverse tilt domain, it is effective to only reduce the transverse electric field generated in the dark pixel and the bright pixel between which the application boundary is interposed.

Here, in order to reduce the transverse electric field generated in the dark pixel and the bright pixel between which the application boundary is interposed, like the embodiment, in addition to the process of changing the dark pixel in the normally black mode into the gray scale level "c1" to correct it in a bright direction, a process of correcting the bright pixel in a dark direction and a process of correcting the dark pixel in a bright direction and correcting the bright pixel in a dark direction may be considered.

The respective processes will be described herein.

Correction of High Voltage Pixel

Firstly, a case where the bright pixel, among the dark pixel and the bright pixel between which the application boundary is interposed, that is, a pixel (high voltage pixel) having a higher voltage applied to the liquid crystal element is corrected, will be described.

In this case, the determining section 310 determines whether the pixel displayed by the video signal Vid-d is adjacent to the application boundary, and whether the gray scale level of the pixel belongs to the gray scale range "b", respectively. Then, if the determination results are all "Yes", the flag Q of the output signal is set to "1", and the gray scale level "c2" is supplied to the input terminal "b" of the selector 314. Here, as shown in FIG. 4A, the gray scale level "c2" belongs to the gray scale range "c", which is a level brighter than the gray scale level "c1".

In such a configuration, when the gray scale level of the pixel displayed by the video signal Vid-in is included in the gray scale range "b" and the pixel is adjacent to the application boundary, the flag Q becomes "1". If the flag Q becomes "1", since the selector 314 selects the input terminal "b", the video signal Vid-d which designates the gray scale level of the gray scale range "b" is replaced by the video signal which designates the gray scale level "c2" and is output as the video signal Vid-out.

Figure 10A:
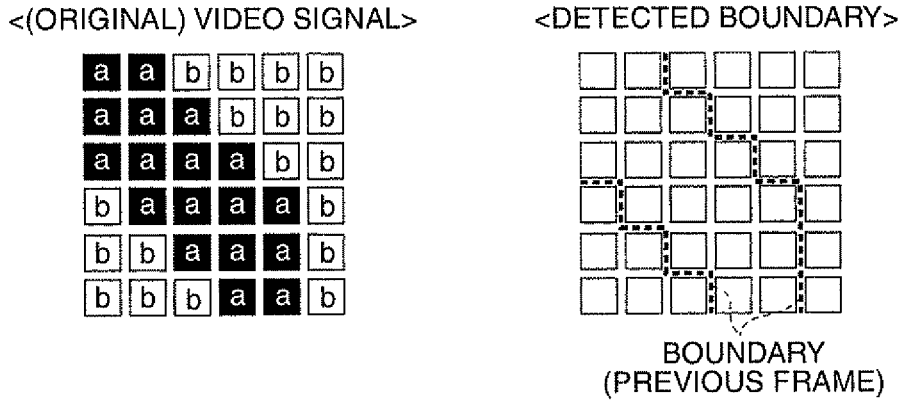
FIGS. 10A to 10C are diagrams illustrating content of another correction process of a video processing circuit according to an embodiment of the invention.
Figure 10B:
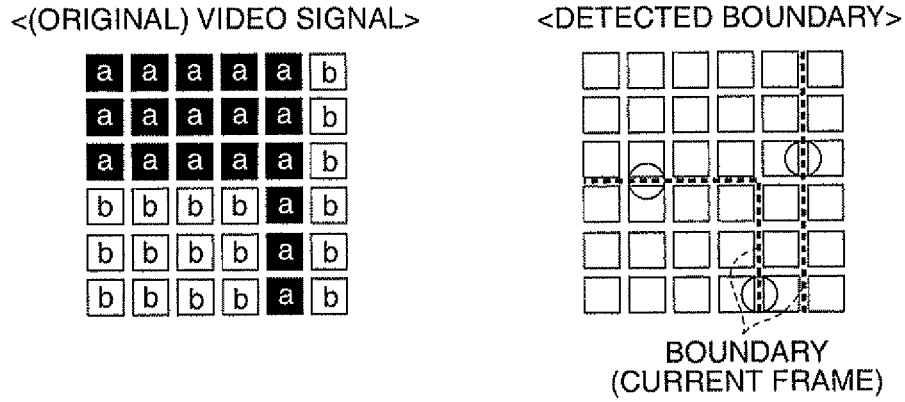
Figure 10C:
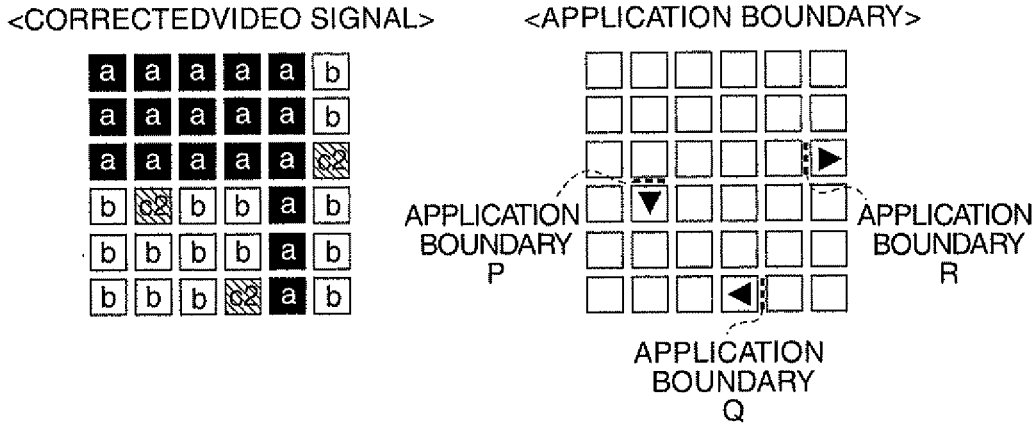

FIGS. 10A to 10C are diagrams illustrating a processing example of a case where the gray scale level of the bright pixel adjacent to the application boundary is replaced. Images of a previous frame and a current frame, a detected boundary and an application boundary are the same as in the example in FIGS. 6A and 6C. However, in this example, since the bright pixel which belongs to the gray scale level "b", among the pixels adjacent to the application boundary, is replaced by the video signal of the gray scale level "c2", it is corrected to a gray scale level as shown in a left section of FIG. 10C. Specifically, a bright pixel positioned below the application boundary P, a bright pixel positioned on the left side of the application boundary Q, and a bright pixel positioned on the right side of the application boundary R are replaced by the gray scale level "c2", respectively.

Figure 11A:
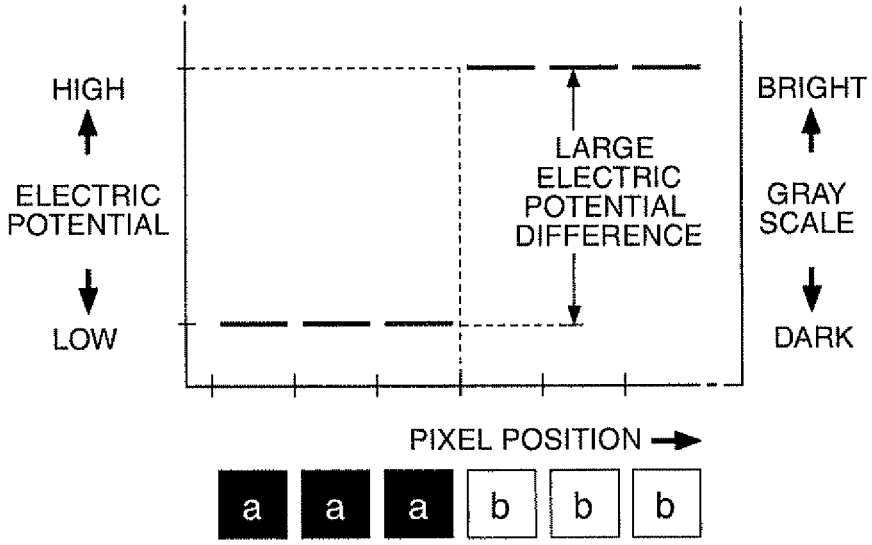
FIGS. 11A and 11B are diagrams illustrating reduction in a transverse electric field according to the correction process.
Figure 11B:
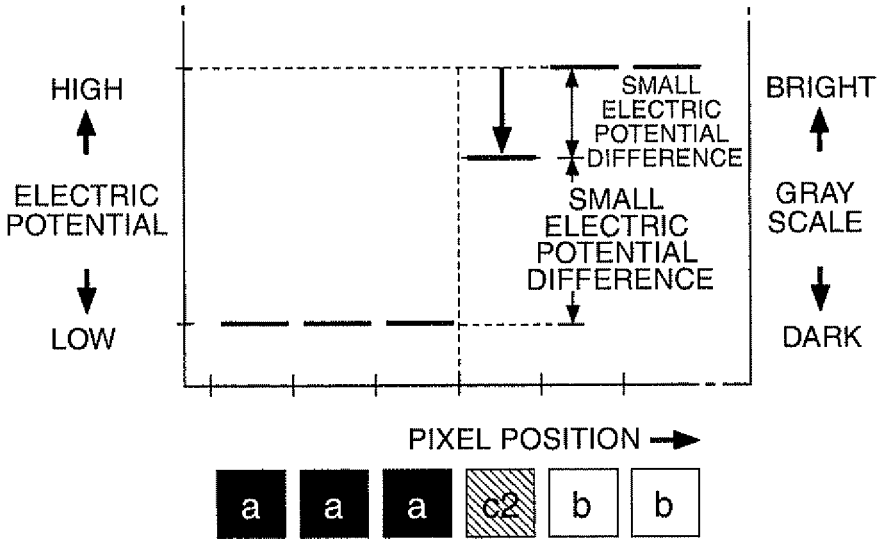

Accordingly, in this example, since the voltage applied to the liquid crystal element of the bright pixel is corrected to be lowered, if the electric potential of the pixel electrode of the bright pixel is positive insertion, as shown in FIG. 11B, it is decreased. Thus, the electric potential difference of the pixel electrode decreases by stages, and thus, generation of the large transverse electric field is suppressed. Accordingly, it is possible to suppress generation of the display defect due to the reverse tilt domain.

In a case where the gray scale level of the bright pixel adjacent to the application boundary is replaced as in the example, with respect to a bright pixel adjacent to the application boundary and at least one bright pixel adjacent to the bright pixel in a direction away from the application boundary, their gray scale levels may be replaced.

Correction of High Voltage Pixel and Low Voltage Pixel

Subsequently, a case of correcting both the dark pixel and the bright pixel between which the application boundary is interposed will be described. In this case, the determining section 310 determines whether the pixel displayed by the video signal Vid-d is adjacent to the application boundary. If it is adjacent to the application boundary, the determining section 310 determines whether the gray scale level of the pixel belongs to the gray scale range "a" or the gray scale range "b". On the other hand, when it is determined that the pixel displayed by the video signal Vid-d is adjacent to the application boundary and the gray scale level of the pixel belongs to the gray scale range "a", the selector 314 may change the gray scale level of the pixel into the gray scale range "c1", and when it is determined that the pixel displayed by the video signal Vid-d is adjacent to the application boundary and the gray scale level of the pixel belongs to the gray scale range "b", the selector 314 may replace the gray scale level of the pixel by the gray scale range "c2".

Figure 12A:
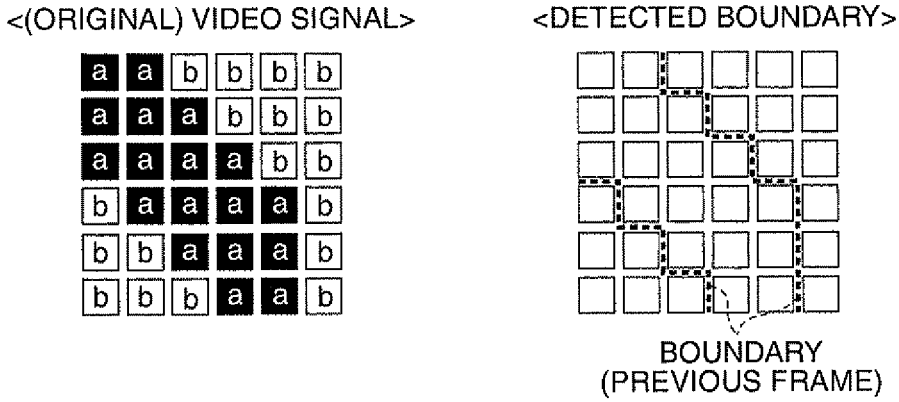
FIGS. 12A to 12C are diagrams illustrating content a still another correction process according to an embodiment of the invention.
Figure 12B:
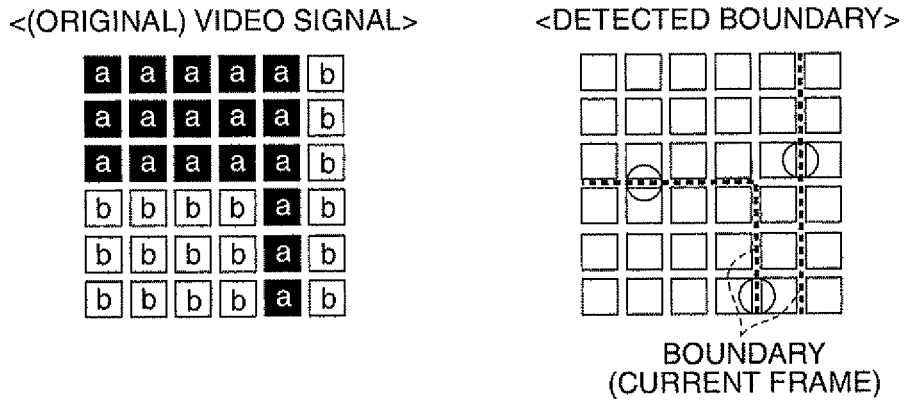
Figure 12C:
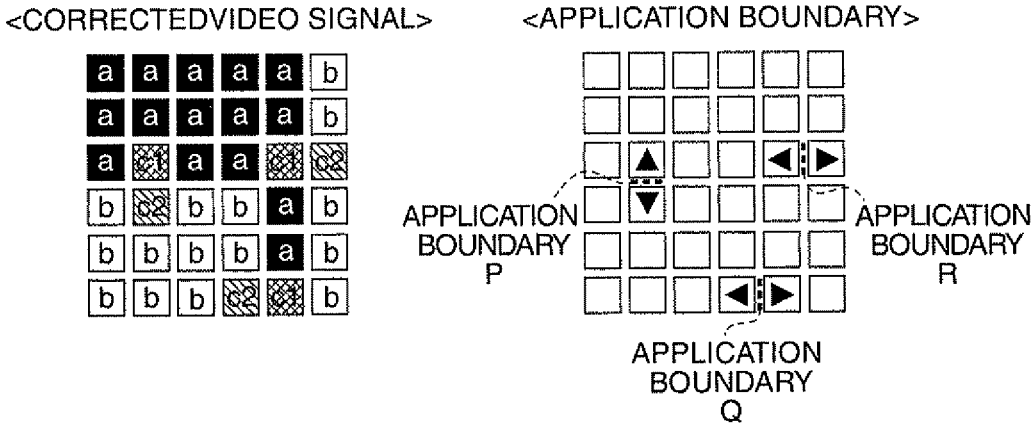

FIGS. 12A to 12C are diagrams illustrating a processing example of a case where the gray scale levels of both of the dark pixel and the bright pixel between which the application boundary is interposed are replaced. Images of a previous frame and a current frame, a detected boundary and an application boundary are the same as in the example in FIGS. 6A and 6C. However, in this example, the dark pixel among the dark pixel and the bright pixel between which the application boundary is interposed is replaced by the video signal of the gray scale level "c1" and the bright pixel is replaced by the video signal of the gray scale level "c2", and thus, they are corrected into the gray scale level as shown in a left section in FIG. 12C.

Figure 13A:
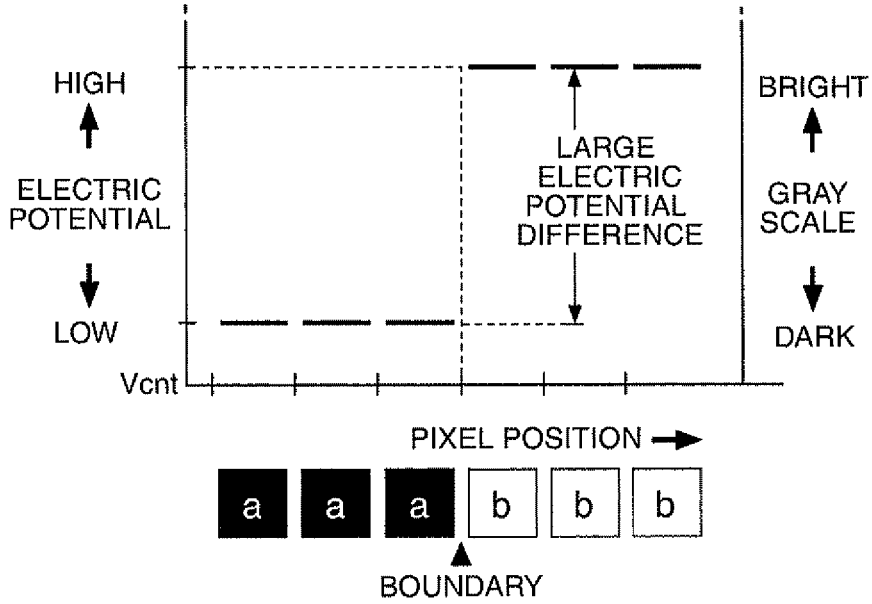
FIGS. 13A to 13B are diagrams illustrating reduction in a transverse electric field according to the correction process.
Figure 13B:
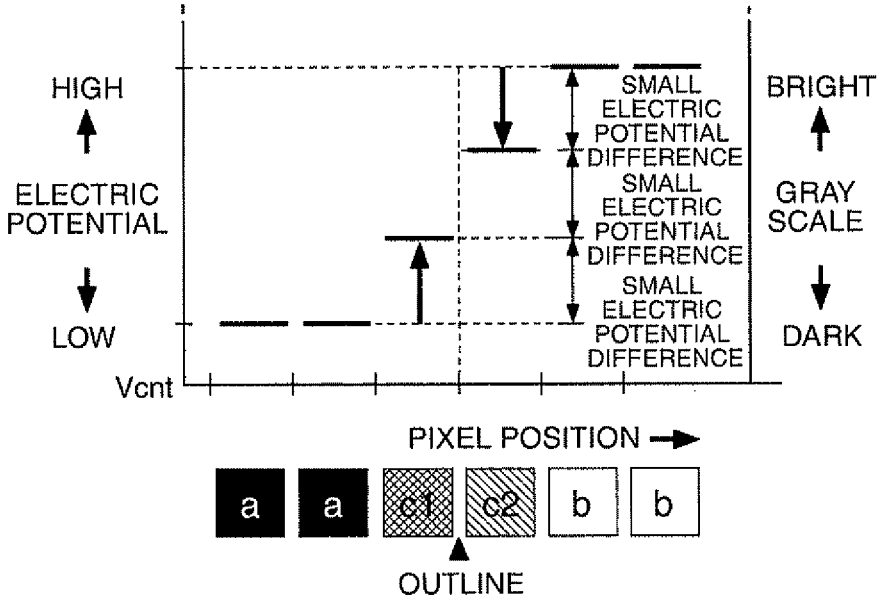

Accordingly, in this example, since the voltage applied to the liquid crystal element of the dark pixel is corrected to be increased and the voltage applied to the liquid crystal element of the bright pixel is corrected to be decreased, if it is positive insertion, as shown in FIG. 13B, the electric potential of the pixel electrode of the dark pixel increases, and the electric potential of the pixel electrode of the bright pixel decreases. Thus, since the electric potential difference of the pixel electrodes decreases by stages to suppress generation of the large transverse electric field, it is possible to suppress generation of the display defect due to the reverse tilt domain.

In particular, in this example, since the gray scale levels of both of the dark pixel and the bright pixel are corrected, a boundary between the dark pixel and the bright pixel is visualized as an outline of a corrected image as it is. Thus, in this example, it is possible to prevent the outline information about the image displayed by the original video signal Vid-in from being lost by correction.

Example 4

Normally White Mode

In the embodiment, the normally black mode in which the liquid crystal 105 uses the VA method is described. However, a normally white mode in which the liquid crystal 105 uses the TN method and the liquid crystal element 120 becomes white when no voltage is applied thereto, may be used.

Figure 4B:
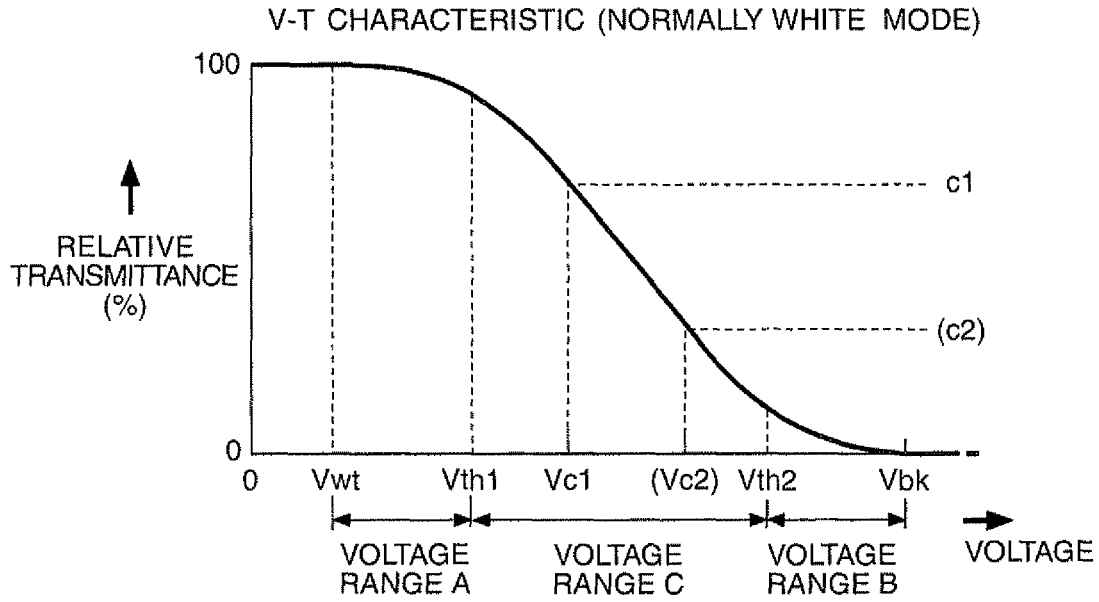

In the case of the normally white mode, the relationship between the applied voltage and the transmittance of the liquid crystal element 120 is indicated by a V-T characteristic shown in FIG. 4B, and the transmittance decreases as the applied voltage increases.

The pixel which is easily affected by the transverse electric field is similarly a pixel where the applied voltage is low, but the pixel where the applied voltage is low becomes a bright pixel in the normally white mode. Thus, in the normally white mode, the video processing circuit 30 may determine an application boundary from a boundary in which a bright pixel supplied with an applied voltage which belongs to the voltage range A and a dark pixel supplied with an applied voltage which belongs to the voltage range B are adjacent to each other, and for example, may perform a process of replacing the video signal Vid-out corresponding to the bright pixel adjacent to the application boundary with the gray scale level "c1" which is darker than the gray scale level corresponding to the voltage range A.

In the above-described embodiments, the video signal Vid-in designates the gray scale level of the pixel, but may directly designate the voltage applied to the liquid crystal element. In a case where the video signal Vid-in designates the voltage applied to the liquid crystal element, a boundary may be determined according to the designated applied voltage to thereby correct the voltage.

Electronic Device

Figure 14:
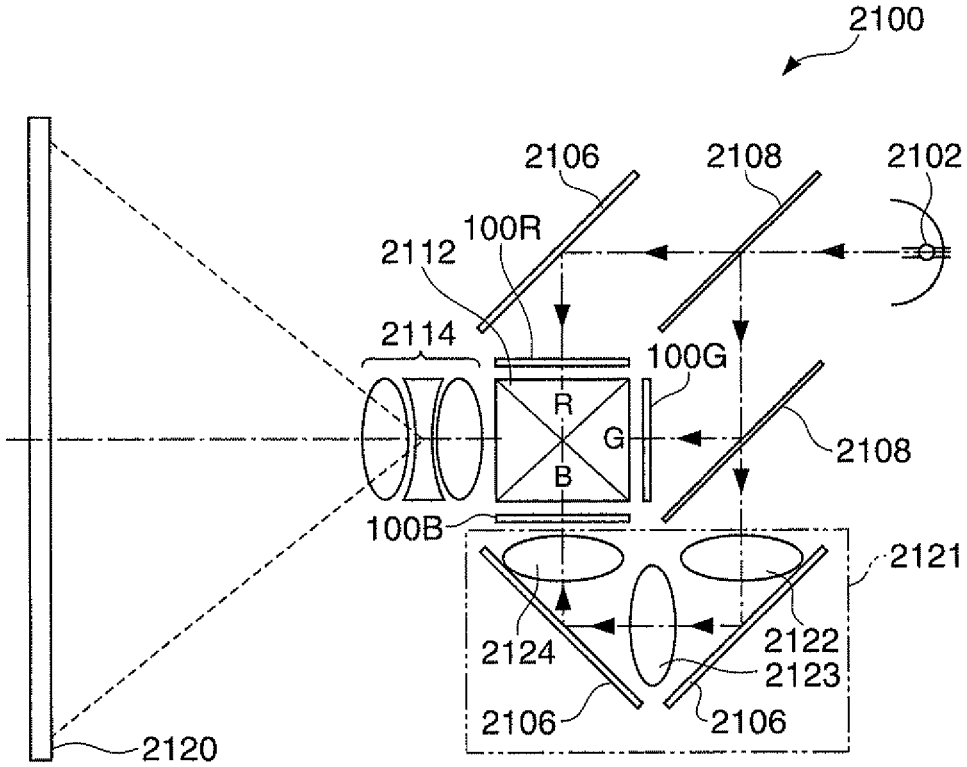
FIG. 14 is a diagram illustrating a projector to which a liquid crystal display apparatus according to an embodiment of the invention is applied.

Next, as an example of an electronic device using the liquid crystal display apparatus according to the above-described embodiment, a projection display apparatus (projector) using the liquid crystal display panel 100 as a light valve will be described. FIG. 14 is a plan view illustrating a configuration of the projector.

As shown in the figure, inside the projector 2100, a lamp unit 2102 including a white light source such as a halogen lamp is installed. A projection light emitted from the lamp unit 2102 is divided into the three primary colors of R (red), G (green) and B (blue) by three mirrors 2106 and two dichroic mirrors 2108 which are disposed therein, and are guided to light valves 1008, 100G and 100B corresponding to the respective primary colors, respectively. Since the B color light is long in its optical path, compared with the R and G colors, the B color light is guided through a relay lens system 2121 including an incident lens 2122, a relay lens 2123 and an exit lens 2124, in order to prevent its loss.

In the projector 2100, three sets of the liquid crystal display apparatuses including the liquid crystal display panel 100 are installed corresponding to the R color, G color and B color, respectively. The configurations of the light valves 100R, 100G and 100B are the same as that in the above-described liquid crystal display panel 100. In order to respectively designate gray scale levels of primary color components of the R, G and B colors, video signals are respectively supplied from an external higher-level circuit, and the light valves 100R, 100G and 100B are driven, respectively.

Lights which are respectively modulated by the light valves 100R, 100G and 100B are incident to a dichroic prism 2112 in three directions. Further, in the dichroic prism 2112, the R and B color lights are refracted at 90 degrees, whereas the G color light goes straight. Accordingly, after images of the respective primary colors are combined, a color image is projected to a screen 2120 by a projection lens 2114.

Since lights corresponding to the respective primary colors of R, G and B are incident to the light valves 100R, 100G and 100B by the dichroic mirror 2108, it is not necessary to install a color filter. Further, transmission images of the light valves 100R and 100B are projected after being reflected by the dichroic prism 2112, but a transmission image of the light valve 100G is projected as it is. Thus, a horizontal scanning direction by means of the light valves 100R and 1008 is reversed to a horizontal scanning direction by means of the light valve 100G, to thereby display an image of which the left and right sides are reversed in the horizontal direction.

As an example in which the liquid crystal display panel 100 is used as the light valve, a rear projection type television is exemplified, in addition to the projector as described with reference to FIG. 14. Further, the liquid crystal display panel 100 can be applied to an electronic viewfinder (EVF) in a digital camera with a mirror-less interchangeable lens, a video camera, or the like.

In addition, as an applicable electronic device, a head mounted display, a car navigation device, a pager, an electronic organizer, a calculator, a word processor, a workstation, a videophone, a POS terminal, a digital still camera, a mobile phone, a device including a touch panel, and the like are exemplified. Further, the liquid crystal display apparatus can be applied to these various electronic devices.

The entire disclosure of Japanese Patent Application No. 2010-006567, filed Jan. 15, 2010 is expressly incorporated by reference herein.

What is claimed is:

1. A video processing circuit which receives a video signal which designates voltage applied to a liquid crystal element for each pixel and regulates each voltage applied to the liquid crystal element on the basis of a corrected video signal, the circuit comprising:

a boundary detecting section which detects a current frame boundary in a current frame of the video signal and a previous frame boundary in a previous frame of the video signal, the current frame boundary and the previous frame boundary being boundaries between first pixels in which the applied voltage designated by the video signal is lower than a first voltage and second pixels in which the applied voltage is equal to or higher than a second voltage, the second voltage being higher than the first voltage; and a correcting section which corrects the voltage applied to the liquid crystal element in the current frame corresponding to at least one of the first pixels and the second pixels in positions where the current frame boundary is different compared to the previous frame boundary by one pixel to correct the input video signal in a direction where a transverse electric field generated in the first pixels and the second pixels is reduced, wherein in a case where the first pixels and the second pixels in the positions between which the portion which moves from the boundary of the previous frame by one pixel is interposed, within the boundary of the current frame, are all second pixels in the previous frame, the correcting section excludes the first pixels and the second pixels in the positions between which the portion is interposed, from a correction target.

2. The video processing circuit according to claim 1, wherein the correcting section corrects, in a direction where the transverse electric field is reduced, the voltage applied to the liquid crystal element corresponding to one or more pixels which are adjacent, on the opposite side, to the first pixels or the second pixels adjacent to the portion which moves from the boundary of the previous frame by one pixel and continue in a direction away from the portion, within the boundary of the current frame.

3. The video processing circuit according to claim 1, wherein the correcting section only corrects the voltage applied to the liquid crystal element in the current frame corresponding to the first pixels in the current frame.

4. The video processing circuit according to claim 1, wherein the correcting section only corrects the voltage applied to the liquid crystal element in the current frame corresponding to the second pixels in the current frame.

5. The video processing circuit according to claim 1, wherein the correcting section corrects the voltage applied to the liquid crystal element by applying a first predetermined voltage level.

6. The video processing circuit according to claim 1, wherein the correcting section corrects the voltage applied to the liquid crystal element by applying a first predetermined voltage level to the first pixels and a second predetermined voltage level to the second pixels.

7. The video processing circuit according to claim 1, wherein the correcting section corrects the voltage applied to the liquid crystal element in the current frame corresponding to at least two pixels extending along a line formed between positions where the current frame boundary is different compared to the previous frame boundary.

8. A video processing method which receives a video signal which designates voltage applied to a liquid crystal element for each pixel and regulates each voltage applied to the liquid crystal element on the basis of a corrected video signal, the method comprising:

detecting a current frame boundary in a current frame of the video signal and a previous frame boundary in a previous frame of the video signal, the current frame boundary and the previous frame boundary being boundaries between first pixels in which the applied voltage designated by the video signal is lower than a first voltage and second pixels in which the applied voltage is equal to or higher than a second voltage, the second voltage being higher than the first voltage; and correcting the voltage applied to the liquid crystal element in the current frame corresponding to at least one of the first pixels and the second pixels in positions where the current frame boundary is different compared to the previous frame boundary by one pixel to correct the input video signal in a direction where a transverse electric field generated in the first pixels and the second pixels is reduced, wherein in a case where the first pixels and the second pixels in the positions between which the portion which moves from the boundary of the previous frame by one pixel is interposed, within the boundary of the current frame, are all second pixels in the previous frame, the correcting section excludes the first pixels and the second pixels in the positions between which the portion is interposed, from a correction target.

9. The video processing method according to claim 8, wherein only the voltage applied to the liquid crystal element in the current frame corresponding to the first pixels in the current frame is corrected.

10. The video processing method according to claim 8, wherein only the voltage applied to the liquid crystal element in the current frame corresponding to the second pixels in the current frame is corrected.

11. The video processing method according to claim 8, wherein the voltage applied to the liquid crystal element is corrected by applying a first predetermined voltage level.

12. The video processing method according to claim 8, wherein the voltage applied to the liquid crystal element is corrected by applying a first predetermined voltage level to the first pixels and a second predetermined voltage level to the second pixels.

13. The video processing method according to claim 8, wherein the voltage applied to the liquid crystal element is corrected in the current frame corresponding to at least two pixels extending along a line formed between positions where the current frame boundary is different compared to the previous frame boundary.

14. A liquid crystal display apparatus comprising:

a liquid crystal display panel which includes a liquid crystal element having liquid crystal which is interposed between a pixel electrode installed on a first substrate corresponding to each of a plurality of pixels and a common electrode installed on a second substrate; and a video processing circuit which receives a video signal which designates voltage applied to the liquid crystal element for each pixel and regulates each voltage applied to the liquid crystal element on the basis of a corrected video signal, wherein the video processing circuit includes:

a boundary detecting section which a current frame boundary in a current frame of the video signal and a previous frame boundary in a previous frame of the video signal, the current frame boundary and the previous frame boundary being boundaries between first pixels in which the applied voltage designated by the input video signal is lower than a first voltage and second pixels in which the applied voltage is equal to or higher than a second voltage, the second voltage being higher than the first voltage; and a correcting section which corrects the voltage applied to the liquid crystal element in the current frame corresponding to at least one of the first pixels and the second pixels in positions where the current frame boundary is different compared to the previous frame boundary by one pixel to correct the input video signal in a direction where a transverse electric field generated in the first pixels and the second pixels is reduced, wherein in a case where the first pixels and the second pixels in the positions between which the portion which moves from the boundary of the previous frame by one pixel is interposed, within the boundary of the current frame, are all second pixels in the previous frame, the correcting section excludes the first pixels and the second pixels in the positions between which the portion is interposed, from a correction target.

15. An electronic device comprising the liquid crystal display apparatus according to claim 14.

* * * * *